US007178429B2

(12) United States Patent
Lin

(10) Patent No.: US 7,178,429 B2
(45) Date of Patent: Feb. 20, 2007

(54) EASY-TO-ASSEMBLE RATCHETING TOOL

(76) Inventor: Yen-Wen Lin, 13F, No. 27, Lane 93, Liu Yang W. Street, Taichung (TW)

( * ) Notice: Subject to any disclaimer, the term of this patent is extended or adjusted under 35 U.S.C. 154(b) by 181 days.

(21) Appl. No.: 10/317,497

(22) Filed: Dec. 12, 2002

(65) Prior Publication Data

US 2004/0055422 A1 Mar. 25, 2004

(30) Foreign Application Priority Data

Aug. 5, 2002 (TW) ..... 91117726 A

(51) Int. Cl.
*B25B 13/46* (2006.01)

(52) U.S. Cl. ..... 81/60; 81/58

(58) Field of Classification Search ..... 81/60–63.2, 81/58

See application file for complete search history.

(56) References Cited

U.S. PATENT DOCUMENTS

| | | | |
|---|---|---|---|
| 15,482 | A | 8/1856 | Gilman |
| 726,012 | A | 4/1903 | Andrew |
| 810,599 | A | 1/1906 | Ansorge |
| 818,761 | A | 4/1906 | Hanes et al. |
| 841,686 | A | 1/1907 | Hatfield |
| 878,657 | A | 2/1908 | Munch |
| 893,097 | A | 7/1908 | Reams |
| 915,446 | A | 3/1909 | Kearnes |
| RE13,205 | E | 2/1911 | Lane |
| 1,033,358 | A | 7/1912 | Turner |
| 1,078,059 | A | 11/1913 | Mossberg |
| 1,090,578 | A | 3/1914 | Smythe |
| 1,194,471 | A | 8/1916 | Boosinger |
| 1,261,092 | A | 4/1918 | Allen |
| 1,382,492 | A | 6/1921 | Evans |

(Continued)

FOREIGN PATENT DOCUMENTS

| | | |
|---|---|---|
| DE | 373436 | 4/1923 |

(Continued)

OTHER PUBLICATIONS

EPO Search Report for Appln. No. EP 00 12 6902 dated Feb. 17, 2003 (3p.) 0570.

(Continued)

*Primary Examiner*—Hadi Shakeri
(74) *Attorney, Agent, or Firm*—Alan D. Kamrath; Nikolai & Mersereau, P.A.

(57) ABSTRACT

A ratcheting tool includes a handle and a head extending from the handle. The handle includes a compartment communicated with a hole of the head. A drive member is rotatably mounted in the hole of the head and includes teeth on an outer periphery thereof. A pawl is slidably mounted in the compartment of the handle. The pawl includes teeth on a side thereof for engaging with the teeth of the drive member. An anchor is mounted in the compartment of the head. An elastic element is attached between the pawl and the anchor for biasing the teeth of the pawl to engage with the teeth of the drive member. A protruded portion is integrally formed on a wall defining the compartment of the handle for positioning the anchor in place, thereby preventing the anchor from moving out of the compartment of the handle.

13 Claims, 18 Drawing Sheets

U.S. PATENT DOCUMENTS

| | | | | |
|---|---|---|---|---|
| 1,426,127 | A | | 8/1922 | Tuttle |
| 1,601,767 | A | | 10/1926 | Peterson |
| 1,614,039 | A | | 1/1927 | Mandl |
| 1,639,078 | A | | 8/1927 | Coe |
| 1,680,515 | A | | 8/1928 | Gormley |
| 1,772,524 | A | | 8/1930 | Seidemann |
| 1,957,462 | A | | 5/1934 | Kress |
| 2,193,984 | A | | 3/1940 | Rhinevault |
| 2,201,705 | A | | 5/1940 | Stone |
| 2,201,827 | A | | 5/1940 | Froeschl et al. |
| 2,542,241 | A | | 2/1951 | Fors |
| 2,612,807 | A | | 10/1952 | Hunt |
| 2,657,604 | A | | 11/1953 | Rueb |
| 2,701,977 | A | | 2/1955 | Stone |
| 2,735,324 | A | | 2/1956 | Goldwater et al. |
| 2,769,360 | A | | 11/1956 | Cottrell et al. |
| 2,800,821 | A | | 7/1957 | Fruscella |
| 2,803,980 | A | | 8/1957 | Vogel |
| 2,891,434 | A | | 6/1959 | Lozensky |
| 2,957,377 | A | | 10/1960 | Hare |
| 2,978,081 | A | | 4/1961 | Lundin |
| 3,019,682 | A | | 2/1962 | Hare |
| 3,044,591 | A | | 7/1962 | Kilness |
| 3,233,481 | A | | 2/1966 | Bacon |
| 3,250,157 | A | | 5/1966 | Badger |
| 3,265,171 | A | | 8/1966 | Kilness |
| 3,269,496 | A | | 8/1966 | Kilness |
| 3,337,014 | A | | 8/1967 | Sandrick |
| 3,342,229 | A | | 9/1967 | Janes |
| 3,349,653 | A | * | 10/1967 | Arnold et al. ..... 81/60 |
| 3,393,587 | A | | 7/1968 | Jolliff et al. |
| 3,393,780 | A | | 7/1968 | Kilness |
| 3,436,992 | A | | 4/1969 | Over et al. |
| 3,508,455 | A | | 4/1970 | Miller |
| 3,575,069 | A | | 4/1971 | White |
| 3,577,816 | A | | 5/1971 | Alexander et al. |
| 3,598,001 | A | | 8/1971 | Thomasian |
| 3,606,940 | A | | 9/1971 | Finkeldei |
| 3,691,876 | A | | 9/1972 | Cassidy, Jr. |
| 3,713,356 | A | | 1/1973 | Knudsen |
| 3,742,788 | A | | 7/1973 | Priest |
| 3,783,703 | A | | 1/1974 | Trimble et al. |
| 3,838,614 | A | | 10/1974 | O'Donnell |
| 3,866,492 | A | | 2/1975 | Knoll |
| 3,908,487 | A | | 9/1975 | Plaw |
| 3,970,155 | A | | 7/1976 | Otto |
| 4,053,037 | A | | 10/1977 | Solomon |
| 4,070,932 | A | | 1/1978 | Jeannotte |
| 4,111,077 | A | | 9/1978 | Cummings et al. |
| 4,128,025 | A | | 12/1978 | Main et al. |
| 4,147,076 | A | | 4/1979 | Wright et al. |
| 4,257,507 | A | | 3/1981 | Solomon |
| 4,274,311 | A | | 6/1981 | Ebert |
| 4,277,989 | A | | 7/1981 | Tracy |
| 4,277,990 | A | | 7/1981 | Hall |
| 4,308,768 | A | | 1/1982 | Wagner |
| 4,308,769 | A | | 1/1982 | Rantanen |
| 4,328,720 | A | | 5/1982 | Shiel |
| 4,336,728 | A | | 6/1982 | Deibert |
| 4,406,186 | A | | 9/1983 | Gummow |
| 4,420,995 | A | | 12/1983 | Roberts |
| 4,485,700 | A | | 12/1984 | Colvin |
| 4,488,460 | A | | 12/1984 | Ballone et al. |
| 4,512,218 | A | | 4/1985 | Chow |
| 4,520,697 | A | | 6/1985 | Moetteli |
| 4,631,988 | A | | 12/1986 | Colvin |
| 4,662,251 | A | | 5/1987 | Kohal |
| 4,709,600 | A | | 12/1987 | Mierbach et al. |
| 4,722,252 | A | | 2/1988 | Fulcher et al. |
| 4,722,253 | A | | 2/1988 | Chow |
| 4,762,033 | A | | 8/1988 | Chow |
| 4,770,072 | A | | 9/1988 | Neuhaus |
| 4,777,852 | A | | 10/1988 | Herman et al. |
| 4,796,492 | A | | 1/1989 | Liou |
| 4,807,500 | A | | 2/1989 | Main |
| 4,862,775 | A | | 9/1989 | Chow |
| 4,869,138 | A | | 9/1989 | Farris |
| 4,903,554 | A | | 2/1990 | Colvin |
| 4,924,737 | A | | 5/1990 | Gummow |
| 4,934,220 | A | | 6/1990 | Slusar et al. |
| 4,986,147 | A | | 1/1991 | Cooper |
| 5,000,066 | A | | 3/1991 | Gentiluomo |
| 5,012,705 | A | | 5/1991 | Chow |
| 5,038,452 | A | | 8/1991 | Beugelsdyk et al. |
| 5,076,121 | A | | 12/1991 | Fosella |
| 5,095,781 | A | | 3/1992 | Blake |
| 5,144,869 | A | | 9/1992 | Chow |
| 5,157,994 | A | | 10/1992 | Krivec |
| 5,178,047 | A | | 1/1993 | Arnold et al. |
| 5,199,330 | A | | 4/1993 | Arnold et al. |
| 5,199,335 | A | | 4/1993 | Arnold et al. |
| 5,230,262 | A | | 7/1993 | Ahlund et al. |
| 5,231,903 | A | | 8/1993 | Bockman, Jr. |
| 5,233,891 | A | | 8/1993 | Arnold et al. |
| 5,271,300 | A | | 12/1993 | Zurbuchen et al. |
| 5,295,422 | A | | 3/1994 | Chow |
| 5,347,892 | A | | 9/1994 | Moetteli |
| 5,392,672 | A | | 2/1995 | Larson et al. |
| 5,404,773 | A | | 4/1995 | Norville |
| 5,425,291 | A | | 6/1995 | Chang |
| 5,448,931 | A | | 9/1995 | Fossella et al. |
| 5,467,672 | A | | 11/1995 | Ashby |
| 5,477,757 | A | | 12/1995 | Maresh |
| 5,495,783 | A | | 3/1996 | Slusar et al. |
| 5,499,560 | A | | 3/1996 | Aeschliman |
| 5,501,124 | A | | 3/1996 | Ashby |
| 5,509,333 | A | | 4/1996 | Rion |
| 5,522,288 | A | | 6/1996 | Slusar et al. |
| 5,533,427 | A | | 7/1996 | Chow |
| 5,535,646 | A | | 7/1996 | Allen et al. |
| 5,557,994 | A | | 9/1996 | Nakayama |
| 5,582,081 | A | | 12/1996 | Lin |
| 5,584,220 | A | | 12/1996 | Darrah et al. |
| 5,595,095 | A | | 1/1997 | Hillinger |
| 5,622,089 | A | | 4/1997 | Gifford, Sr. |
| 5,626,061 | A | | 5/1997 | Whitley |
| 5,626,062 | A | | 5/1997 | Colvin |
| 5,636,557 | A | * | 6/1997 | Ma ..... 81/60 |
| 5,669,875 | A | | 9/1997 | van Eerdenburg |
| 5,709,137 | A | | 1/1998 | Blacklock |
| 5,749,272 | A | | 5/1998 | Phan |
| 5,782,147 | A | | 7/1998 | Chaconas et al. |
| 5,794,496 | A | | 8/1998 | Arnold |
| 5,829,326 | A | | 11/1998 | Richner |
| 5,842,391 | A | | 12/1998 | Chaconas |
| 5,857,390 | A | | 1/1999 | Whiteford |
| 5,873,286 | A | | 2/1999 | Van Lenten |
| 5,878,635 | A | | 3/1999 | Hsieh |
| 5,884,537 | A | | 3/1999 | Chen |
| 5,884,538 | A | | 3/1999 | Van Lenten |
| 5,887,493 | A | | 3/1999 | Main |
| 5,901,620 | A | | 5/1999 | Arnold |
| 5,910,197 | A | | 6/1999 | Chaconas |
| 5,911,798 | A | | 6/1999 | Arnold |
| 5,913,954 | A | | 6/1999 | Arnold et al. |
| 5,927,158 | A | | 7/1999 | Lin |
| 5,946,987 | A | | 9/1999 | Wei |
| 5,946,989 | A | | 9/1999 | Hsieh |
| 5,957,009 | A | | 9/1999 | McCann |
| 5,964,129 | A | | 10/1999 | Shiao |
| 5,970,552 | A | | 10/1999 | Kwiecien et al. |
| 5,979,274 | A | | 11/1999 | Hsieh |
| 5,996,453 | A | | 12/1999 | Blacklock |
| 6,000,302 | A | | 12/1999 | Chiang |

| | | | | |
|---|---|---|---|---|
| 6,006,631 | A | 12/1999 | Miner et al. | |
| 6,044,731 | A | 4/2000 | Hsieh | |
| 6,065,374 | A | 5/2000 | Taggart | |
| 6,125,722 | A | 10/2000 | Hopper, Jr. et al. | |
| 6,134,990 | A | 10/2000 | Ling et al. | |
| 6,134,991 | A | 10/2000 | Chaconas | |
| D433,896 | S | 11/2000 | Wei | |
| D434,292 | S | 11/2000 | Hsieh | |
| 6,152,826 | A | 11/2000 | Profeta et al. | |
| 6,155,140 | A | 12/2000 | Tsai | |
| 6,161,454 | A | 12/2000 | Chaconas | |
| 6,164,167 | A | 12/2000 | Chen | |
| 6,205,889 | B1 * | 3/2001 | Hsieh | 81/60 |
| 6,209,423 | B1 | 4/2001 | Shiao | |
| 6,216,563 | B1 | 4/2001 | Hsieh | |
| 6,216,567 | B1 | 4/2001 | Hu | |
| 6,220,123 | B1 | 4/2001 | Chen | |
| 6,230,591 | B1 | 5/2001 | Ling et al. | |
| 6,240,813 | B1 | 6/2001 | Hyatt | |
| 6,257,096 | B1 | 7/2001 | Ling | |
| 6,257,097 | B1 | 7/2001 | I-He | |
| 6,260,448 | B1 | 7/2001 | Chaconas | |
| 6,260,449 | B1 | 7/2001 | I-He | |
| 6,263,767 | B1 | 7/2001 | Hu | |
| 6,282,991 | B1 | 9/2001 | Hu | |
| 6,282,992 | B1 | 9/2001 | Hu | |
| 6,282,993 | B1 | 9/2001 | Forman et al. | |
| 6,301,998 | B1 | 10/2001 | Hu | |
| 6,308,594 | B1 | 10/2001 | Cheng | |
| 6,332,382 | B1 | 12/2001 | Anderson et al. | |
| 6,334,373 | B1 | 1/2002 | Hsieh | |
| 6,382,051 | B1 * | 5/2002 | Chang | 81/60 |
| 6,382,052 | B1 | 5/2002 | Chen | |
| 6,386,072 | B1 | 5/2002 | Yuan-Chin et al. | |
| 6,427,560 | B1 | 8/2002 | Shea | |
| 6,431,031 | B1 | 8/2002 | Hu | |
| 6,435,062 | B1 | 8/2002 | McCann | |
| 6,435,063 | B1 | 8/2002 | Chen | |
| 6,450,066 | B1 | 9/2002 | Hu | |
| 6,450,068 | B1 | 9/2002 | Hu | |
| 6,453,779 | B2 | 9/2002 | Hu | |
| 6,457,387 | B1 | 10/2002 | Hu | |
| 6,457,388 | B1 | 10/2002 | Chen | |
| 6,457,389 | B1 | 10/2002 | Hu | |
| 6,467,378 | B1 * | 10/2002 | Chen | 81/60 |
| 6,488,136 | B2 | 12/2002 | Chang | |
| 6,516,691 | B1 | 2/2003 | Wei | |
| 6,520,051 | B1 | 2/2003 | Hu | |
| 6,539,825 | B1 | 4/2003 | Lin | |
| 6,568,299 | B2 | 5/2003 | Hu | |
| 6,591,717 | B2 | 7/2003 | Wei | |
| 6,629,477 | B2 | 10/2003 | Ling et al. | |
| 6,644,148 | B2 | 11/2003 | Hu | |
| 6,647,832 | B2 | 11/2003 | Hu | |
| 6,662,693 | B2 | 12/2003 | Hu | |
| 6,666,112 | B2 | 12/2003 | Hu | |
| 6,666,117 | B2 | 12/2003 | Hu | |
| 6,688,195 | B1 | 2/2004 | Hsien | |
| 6,708,586 | B1 | 3/2004 | Chen | |
| 6,722,234 | B2 | 4/2004 | Hu | |
| 6,732,614 | B2 | 5/2004 | Hu | |
| 6,745,647 | B2 | 6/2004 | Wang | |
| 6,748,825 | B2 | 6/2004 | Hsu | |
| 6,758,641 | B2 | 7/2004 | Hu | |
| 6,761,092 | B2 | 7/2004 | Hsien | |
| 2002/0023520 | A1 | 2/2002 | Hu | |
| 2002/0162423 | A1 | 11/2002 | Hu | |
| 2002/0162424 | A1 | 11/2002 | Hu | |
| 2002/0166417 | A1 | 11/2002 | Hu | |
| 2002/0166418 | A1 | 11/2002 | Hsieh | |
| 2002/0194950 | A1 | 12/2002 | Hu | |
| 2003/0010159 | A1 | 1/2003 | Hu | |
| 2003/0070512 | A1 | 4/2003 | Hu | |
| 2003/0121373 | A1 | 7/2003 | Ling et al. | |
| 2003/0154826 | A1 | 8/2003 | Lee | |
| 2003/0196522 | A1 | 10/2003 | Hu | |
| 2004/0093995 | A1 | 5/2004 | Hu | |

FOREIGN PATENT DOCUMENTS

| | | |
|---|---|---|
| DE | 921198 | 7/1949 |
| DE | 1810811 | 6/1970 |
| DE | DE 2 9907467 | 9/1999 |
| DE | DE 2 9910932 | 9/1999 |
| FR | 498276 | 1/1920 |
| GB | 1559093 | 1/1980 |
| GB | 2135226 | 8/1984 |
| TW | 130638 | 4/1998 |
| TW | 212343 | 8/1999 |
| TW | 310649 | 12/2005 |

OTHER PUBLICATIONS

Appeal Brief against Office Action on Opposition to Patent Application No. 089200570 P01 in Taiwan and translation of same.

First Office Action on Patent Appl. No. 001003289 in People's Republic of China and Translation.

Office Action by Taiwan Intellectual Property Office on Opposition to Patent Appl. No. 089200570 in Taiwan and Translation; and Translations of Taiwanese Patent Publication No. 212343, of Taiwanese Patent Publication No. 310649, and of Taiwanese Patent Publication No. 130638.

Decision by the Board of Appeal and Translation of same.

Taiwan Intellectual Properry Office's Answer to Appeal Brief and Translation of same.

Complaint for Declatory Judgment of Noninfringement, Unemforceability, and Invalidity of a Patent, dated Sep. 26, 2002.

Amended Complaint for Declatory Judgment of Noninfringement, Unenforceability, and Invalidity of a Patent, dated Sep. 19, 2003.

Plaintiff's Second Supplemental Response to Interrogatory No. 3 of Defendant's First Set of Interrogatories, dated Apr. 21, 2004.

Tool and Manufacturing Engineers Handbook, 1976, 3rd Edition, pp. 6-48.

* cited by examiner

EASY-TO-ASSEMBLE RATCHETING TOOL

BACKGROUND OF THE INVENTION

1. Field of the Invention

The present invention relates to a ratcheting tool. In particular, the present invention relates to a ratcheting tool that is easy to assemble.

2. Description of the Related Art

Taiwan Patent Publication No. 335750 discloses a ratcheting wrench comprising a handle and a head on an end of the handle. The head includes a hole for rotatably receiving a drive member. A compartment is defined in a periphery defining the hole of the head, and a pawl is received in the compartment. A wall defining the compartment includes two positioning holes for engaging with two protrusions on an anchor received in the compartment. A spring has a first end received in a receptacle in the anchor and a second end attached to a side of the pawl. The pawl has a toothed face for engaging with teeth of the drive member. Thus, when the handle turns freely in a direction without driving a fastener that is engaged with the drive member, the pawl is moved toward the anchor and compresses the spring that returns the pawl to a position for engaging with the drive member. However, positioning of the anchor is not easy, and the wall defining the compartment is the only place for positioning the anchor. Further, an end cover is required to prevent disengagement of the anchor. Further, the torque-bearing capacity of the ratcheting wrench is reduced. In an extreme case, the end cover flies away from the head of the handle if the torque transmitted to the anchor is considerably high. Further, the time for manufacturing and assembling the ratcheting wrench is long, resulting in a high cost. Moreover, the anchor could not be used with a ratcheting wrench having a closed compartment.

Taiwan Patent Publication No. 431260 discloses a ratcheting wrench comprising a handle and a head on an end of the handle. The head includes a hole for rotatably receiving a drive member. A compartment is defined in a periphery defining the hole of the head, and a pawl is received in the compartment. An anchor is mounted in the compartment and includes a fulcrum in contact with a wall defining the compartment. The anchor further includes a pair of protrusions on an end thereof for alternately engaging with teeth of the drive member. Thus, the anchor sways but does not slide in the compartment. A spring is attached between the other end of the anchor and a side of the pawl. The pawl has a toothed face for engaging with the teeth of the drive member. Thus, when the handle turns idly, the pawl is moved toward the anchor and compresses the spring that returns the pawl to a position for engaging with the drive member. However, the pair of protrusions of the anchor alternately engaged with the teeth of the drive member during idle rotation of the handle cause wear to the teeth of the drive member. Further, the anchor risks getting stuck in the compartment during idle rotation of the handle, as there is no means for limiting movement of the anchor in the compartment when the anchor is subject to a force from the pawl. Further, the location of the anchor affects operation of the wrench. More specifically, if the swayable anchor is adjacent to the drive member, the swaying angle for the anchor could be too small, and if the swayable anchor is distal to the drive member, the swaying angle for the anchor could be too large. This increases difficulty in assembly of the ratcheting wrench of this type. Further, when the handle is subject to vibrations and/or hammering, the anchor may move to a position not allowing swaying movement of the anchor.

FIGS. 1 and 2 of the drawings illustrate a conventional ratcheting tool comprising a handle 1 and a head on an end of the handle. The head includes a hole for rotatably receiving a drive member 2. A compartment 9 is defined in a periphery defining the hole of the head, and a pawl 3 is received in the compartment 9. An anchor 4 is mounted in the compartment 9 and includes a transverse hole 8. A spring 6 is attached between the anchor 4 and the pawl 3. The handle 1 further includes a transverse hole 7 communicated with the compartment 9. In assembly, a pin 5 is extended through the transverse hole 7 of the handle 1 and the transverse hole 8 of the anchor 4 to thereby position the anchor 4. However, troublesome drilling of holes is required. Further, the assembling procedure is troublesome, as the transverse hole 8 of the anchor 4 must be aligned with the transverse hole 7 of the handle 1 before inserting the pin 5.

SUMMARY OF THE INVENTION

An object of the present invention is to provide ratcheting tool that is easy to assemble.

A ratcheting tool in accordance with the present invention comprises a handle and a head extending from the handle. The head includes a hole, and the handle includes a compartment communicated with the hole of the head. A drive member is rotatably mounted in the hole of the head and includes a plurality of teeth on an outer periphery thereof. A pawl is slidably mounted in the compartment of the handle. The pawl includes a plurality of teeth on a side thereof for engaging with the teeth of the drive member. An anchor is mounted in the compartment of the head. An elastic element is attached between the pawl and the anchor for biasing the teeth of the pawl to engage with the teeth of the drive member. A protruded portion is integrally formed on a wall defining the compartment of the handle for positioning the anchor in place, thereby preventing the anchor from moving out of the compartment of the handle.

Other objects, advantages, and novel features of the invention will become more apparent from the following detailed description when taken in conjunction with the accompanying drawings.

DETAILED DESCRIPTION OF THE PREFERRED EMBODIMENTS

Figure 3:
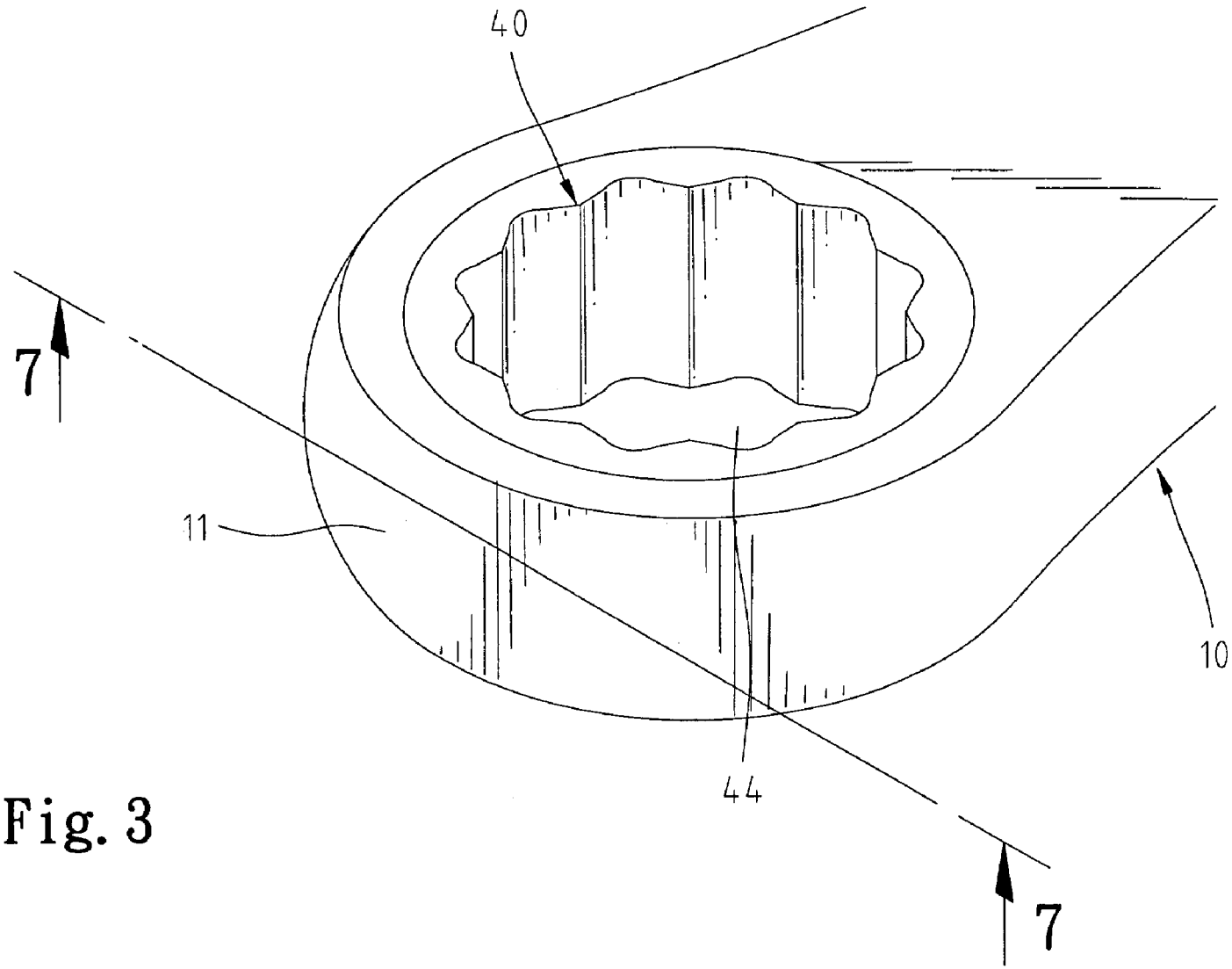
FIG. 3 is a perspective view of a first embodiment of a ratcheting tool in accordance with the present invention.
Figure 4:
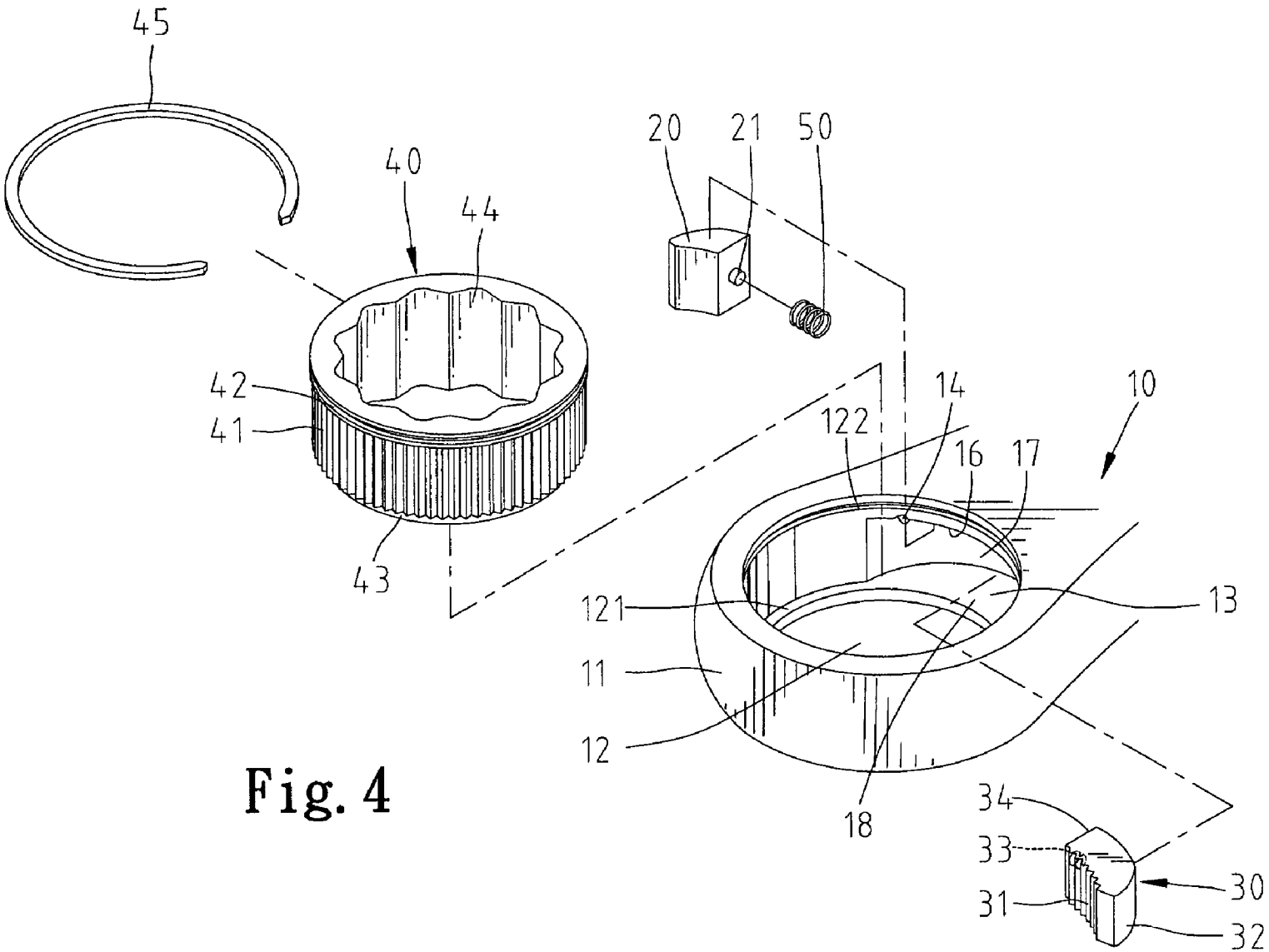
FIG. 4 is an exploded perspective view of the ratcheting tool in FIG. 3.
Figure 5:
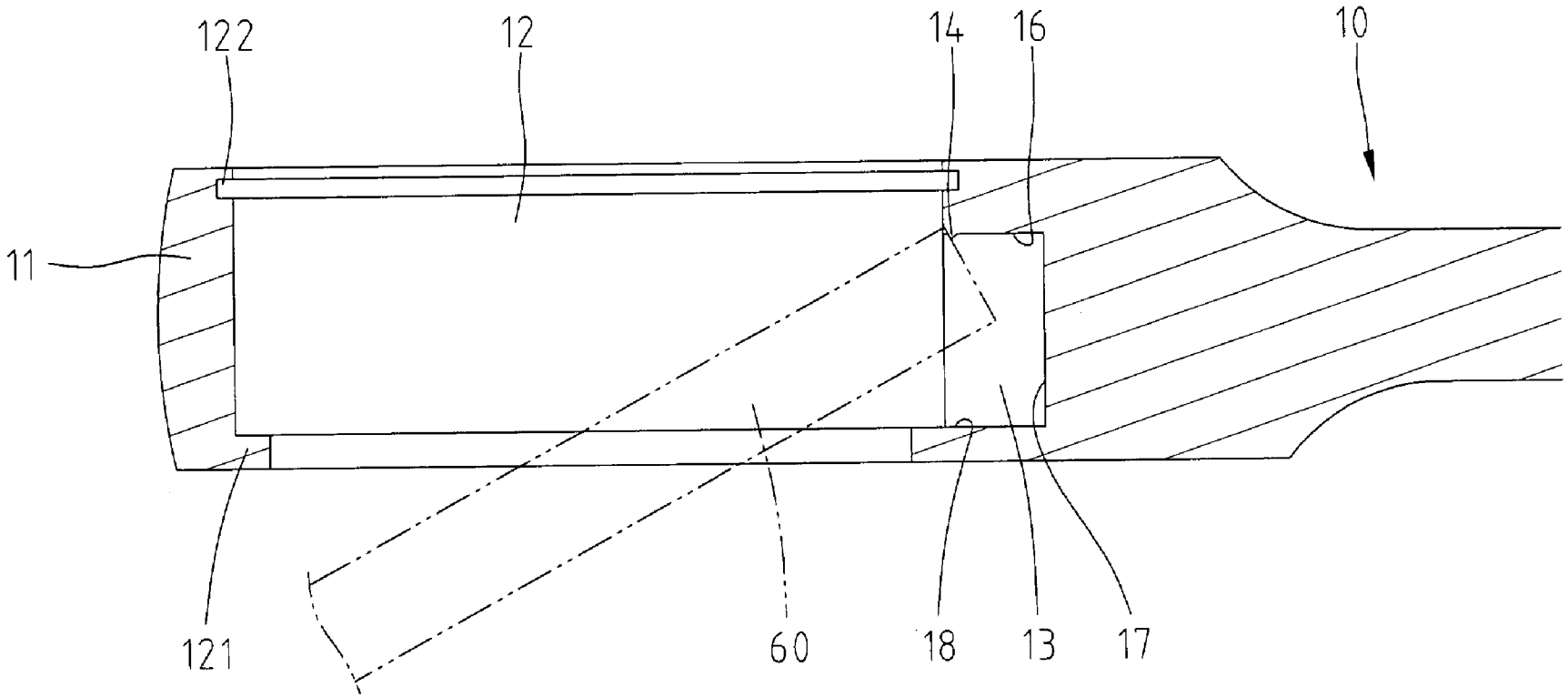
FIG. 5 is a sectional view illustrating formation of a protruded portion in the ratcheting tool in accordance with the present invention.

Referring to FIGS. 3 and 4, a first embodiment of a ratcheting tool in accordance with the present invention generally comprises a handle 10 and a head 11 extending from the handle 10. The head 11 includes a hole 12, with an annular ledge 121 formed on a lower end of a periphery defining the hole 12 and with an annular groove 122 defined in an upper end of the periphery defining the hole 12. The handle 10 includes a compartment 13 defined by a top wall 16, a bottom wall 18 and a lateral wall 17 and communicated with the hole 12 of the head 11. As illustrated in FIG. 5, a protruded portion 14 is integrally formed on the top wall 16 defining the compartment 13 by using a punch 60.

A drive member 40 (e.g., a gear wheel in this embodiment) is rotatably mounted in the hole 12 of the head 11. In this embodiment, the drive member 40 includes an outer periphery, with an annular groove 42 defined in an upper portion of the outer periphery, with an annular recessed portion 43 formed on a lower portion of the outer periphery, and with a plurality of teeth 41 formed between the upper portion and the lower portion of the outer periphery of the drive member 40. The drive member 40 further has an inner periphery 44 for engaging with a fastener such as a bolt head, nut, etc. A C-clip 45 is partially received in the annular groove 42 of the drive member 40 and partially received in the annular groove 122 of the head 11. Thus, the drive member 40 is rotatably mounted in the hole 12 of the head 11. The annular recessed portion 43 of the drive member 40 rests on the annular ledge 121 of the head 11 to thereby prevent the drive member 40 from falling out of the hole 12 of the head 11 as shown in FIG. 8.

Figure 6:
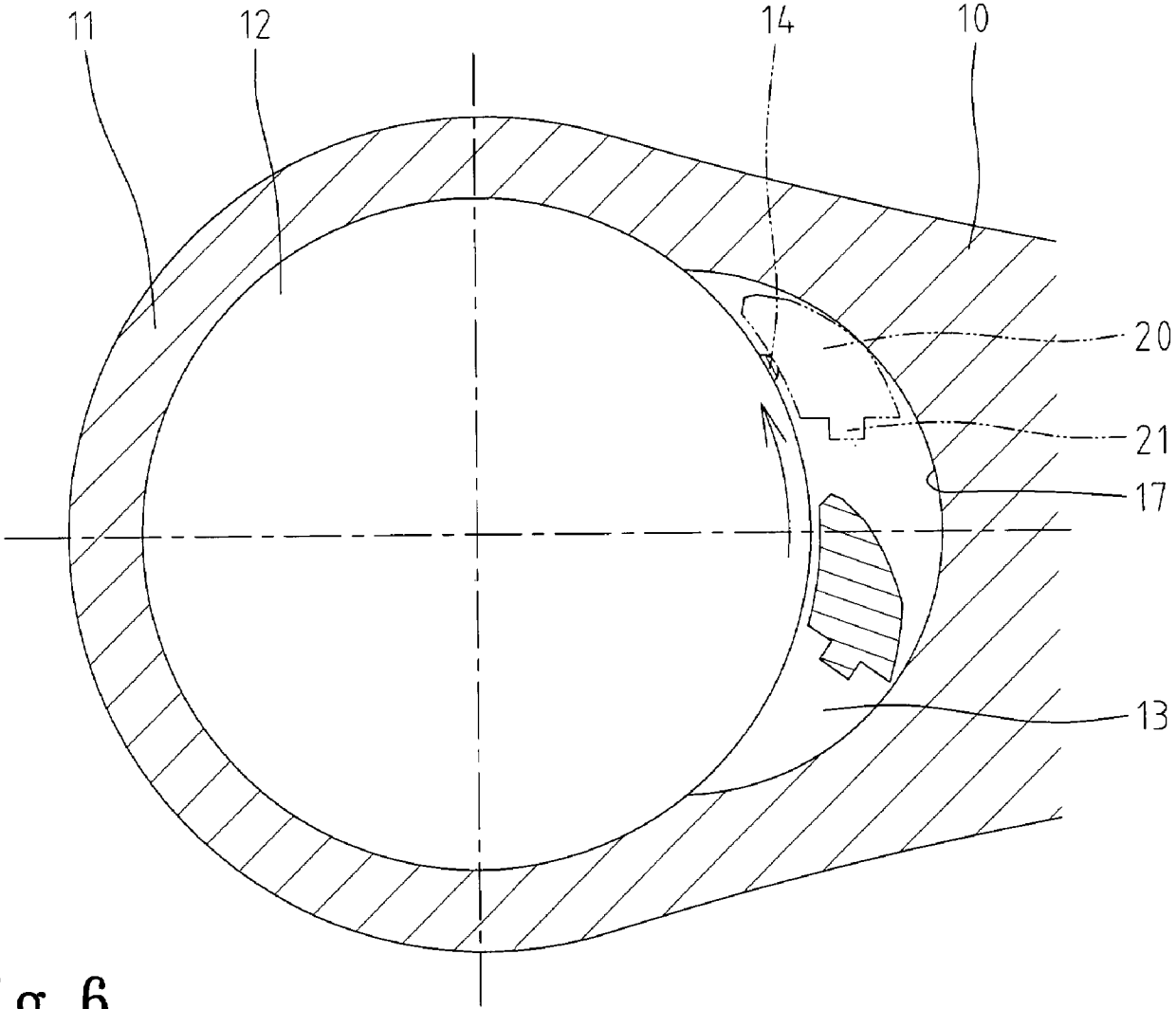
FIG. 6 is a sectional view illustrating mounting of an anchor of the ratcheting tool in accordance with the present invention.

An anchor 20 is mounted in the compartment 13 of the handle 10. The anchor 20 includes a peg 21 on a face thereof As illustrated in FIG. 6, the anchor 20 is inserted into the compartment 13 of the handle 10 and slid to a position between the protruded portion 14 and the lateral wall 17 defining the compartment 13 of the handle 10. Thus, a front side of the anchor 20 is stopped by the protruded portion 14, and a rear side of the anchor 20 is stopped by the lateral wall 17 defining the compartment 13 of the handle 10. Namely, the anchor 20 is securely sandwiched between the protruded portion 14 and the lateral wall 17 defining the compartment 13 of the handle 10. Movement of the anchor 20 out of the compartment 13 of the handle 10 is thus prevented. Namely, further upward movement of the anchor 20 is prevented.

Figure 7:
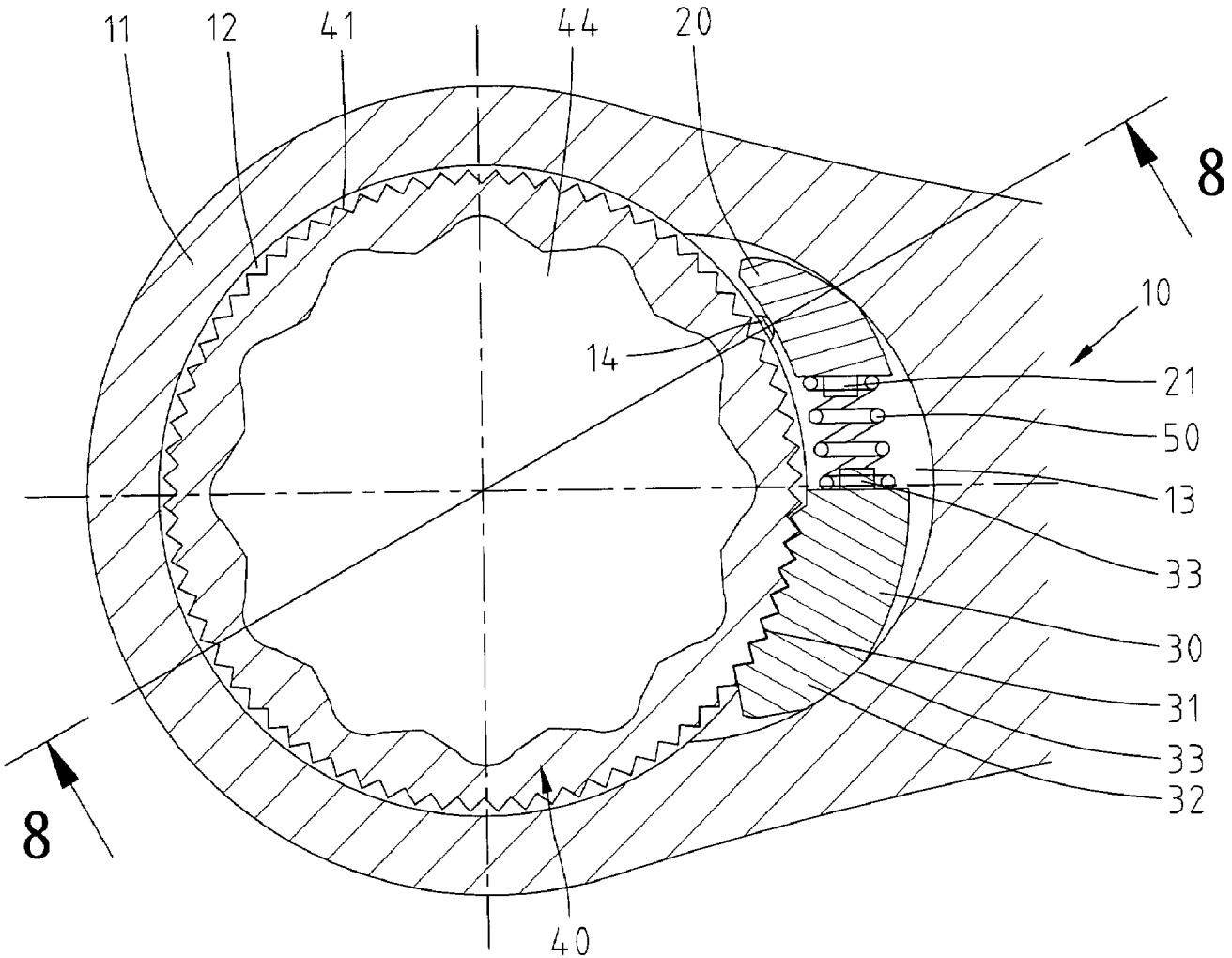
FIG. 7 is a sectional view taken along plane 7—7 in FIG. 3.

A pawl 30 is slidably mounted in the compartment 13 of the handle 10. The pawl 30 includes a side having a plurality of teeth 31 for engaging with the teeth 41 of the drive member 40. The pawl 30 further includes a portion 32 (FIG. 7) pressing against the lateral wall 17 defining the compartment 13 of the handle 10. Further, the pawl 30 includes an end 34 having a peg 33 formed thereon. As illustrated in FIG. 7, an elastic element 50 is attached between the peg 33 of the pawl 30 and the peg 21 of the anchor 20, thereby biasing the teeth 31 of the pawl 30 to engage with the teeth 41 of the drive member 40. Operation of the ratcheting tool is conventional and therefore not described.

Figure 1:
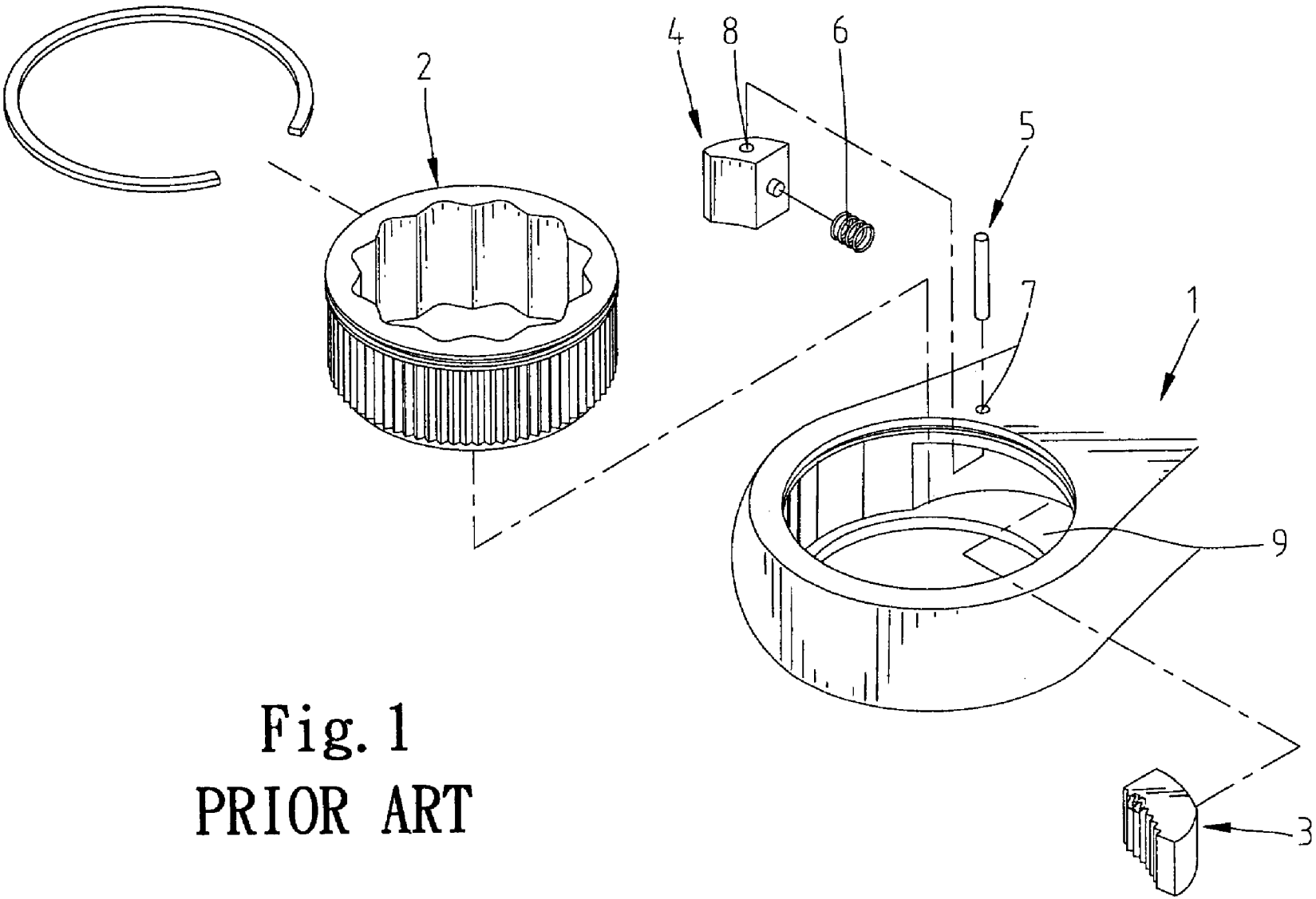
Fig. 1 PRIOR ART
FIG. 1 is an exploded perspective view of a conventional ratcheting tool.
Figure 2:
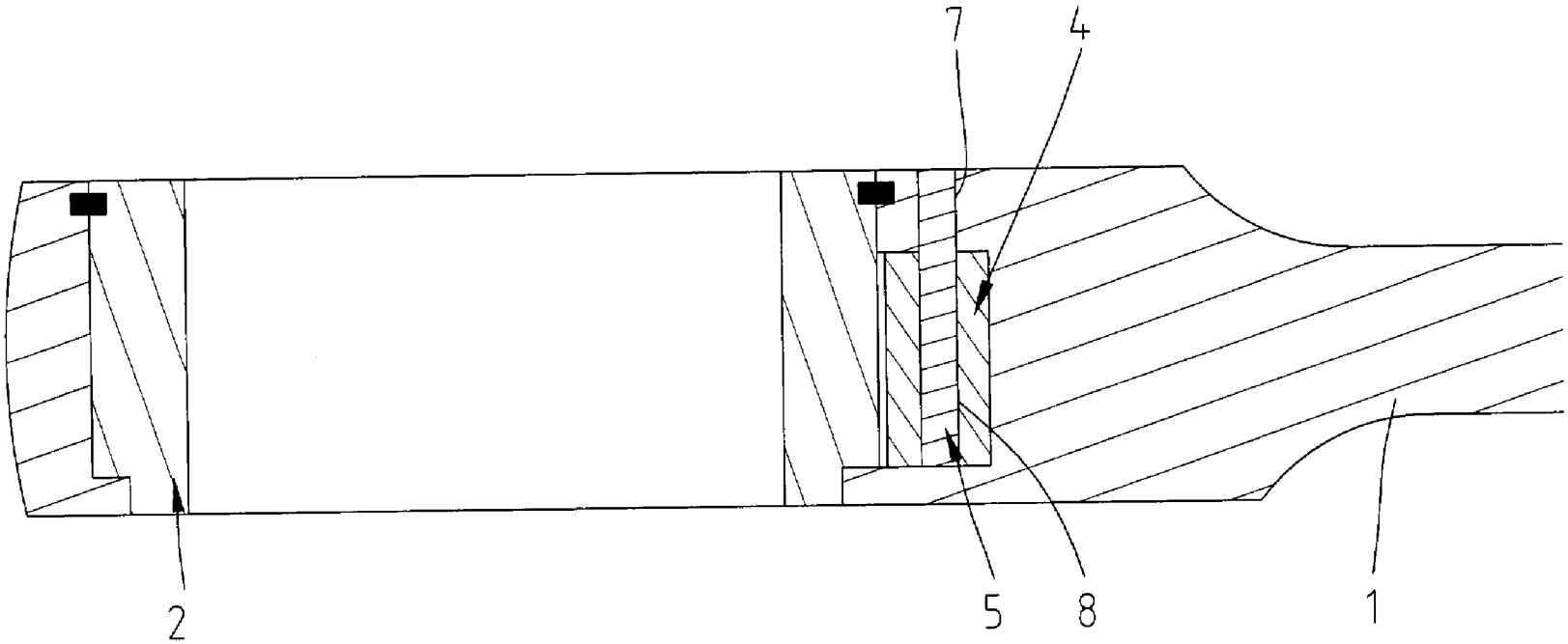
Fig. 2 PRIOR ART
FIG. 2 is a sectional view of the conventional ratcheting tool in FIG. 1.
Figure 8:
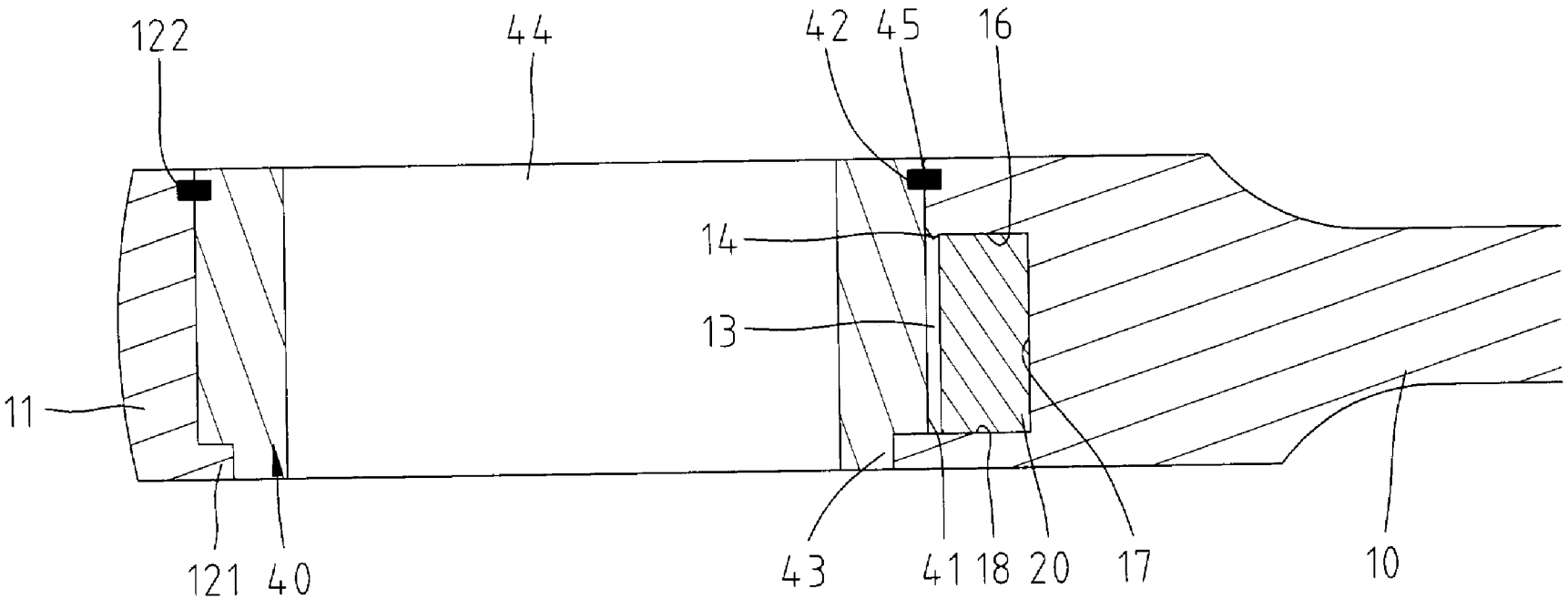
FIG. 8 is a sectional view taken along plane 8—8 in FIG. 7.

As illustrated in FIGS. 7 and 8, since the anchor 20 is stopped by the protrusion 14 and the lateral wall 17 defining the compartment 13 of the handle 10 and since an end of the elastic element 50 is attached to the peg 21 of the anchor 20, the anchor 20 would not move to a position outside the compartment 13 of the handle 10. Thus, the anchor 20 would not come into contact with the teeth 41 of the drive member 40, thereby preventing damage to the teeth 41 of the drive member 40 during operation of the ratcheting tool. Further, none of the handle 10 and the anchor 20 requires a drilling procedure for forming a hole required in the conventional ratcheting tool in FIGS. 1 and 2. The surface of the handle 10 is neat, and-the cost is saved. Further, tolerances of the elements of the ratcheting tools become unimportant due to the way the anchor 20 is mounted. The ratcheting tool in accordance with the present invention is thus more reliable when compared with conventional designs.

Figure 9:
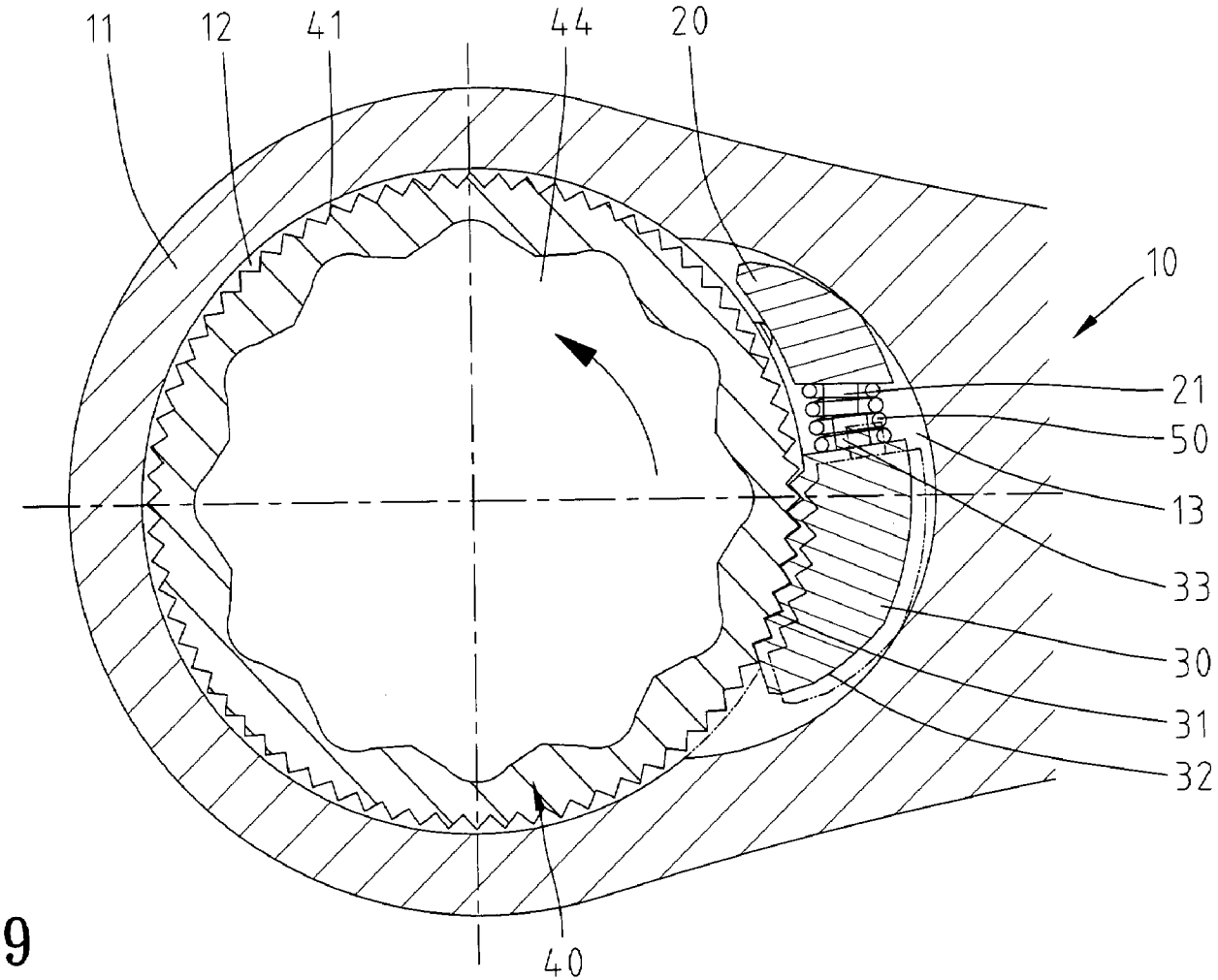
FIG. 9 is a sectional view similar to FIG. 7, illustrating sticking prevention of the ratcheting tool in accordance with the present invention.

FIG. 9 illustrates sticking prevention provided by the anchor 20. If the pawl 30 rusts and is thus stuck on the drive member 40, when the handle 10 is turned, e.g., clockwise, the pawl 30 moves together with the drive member 40 until the peg 33 of the pawl 30 impinges the peg 21 of the anchor 20. Further movement of the pawl 30 is stopped, and the pawl 30 disengages from the drive member 40 that keeps on its rotational movement. Thus, the pawl 30 moves to a position shown by the phantom lines in FIG. 9. Namely, the sticking problem of the pawl 30 is solved.

Figure 10:
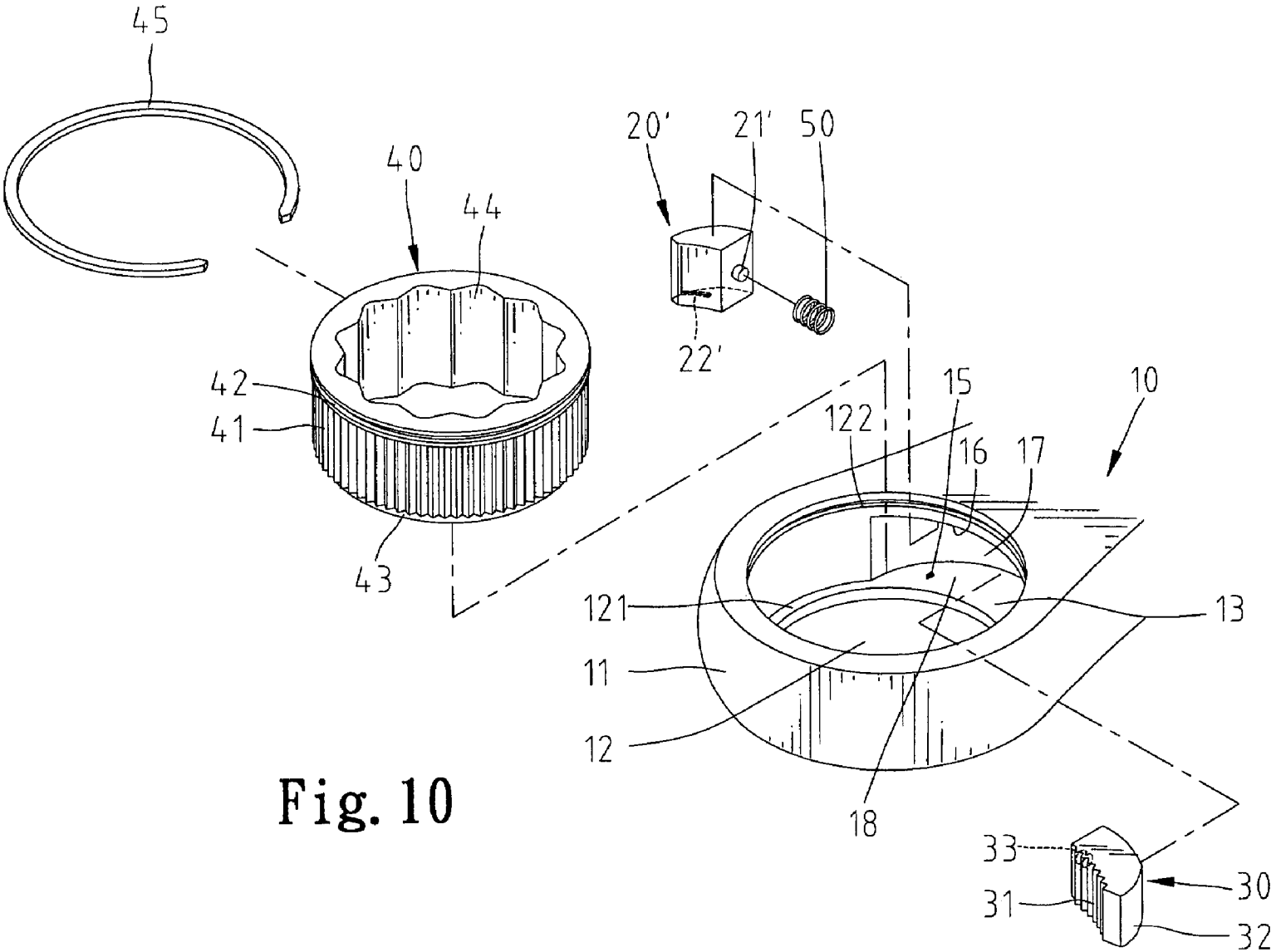
FIG. 10 is an exploded perspective view of a second embodiment of the ratcheting tool in accordance with the present invention.
Figure 11:
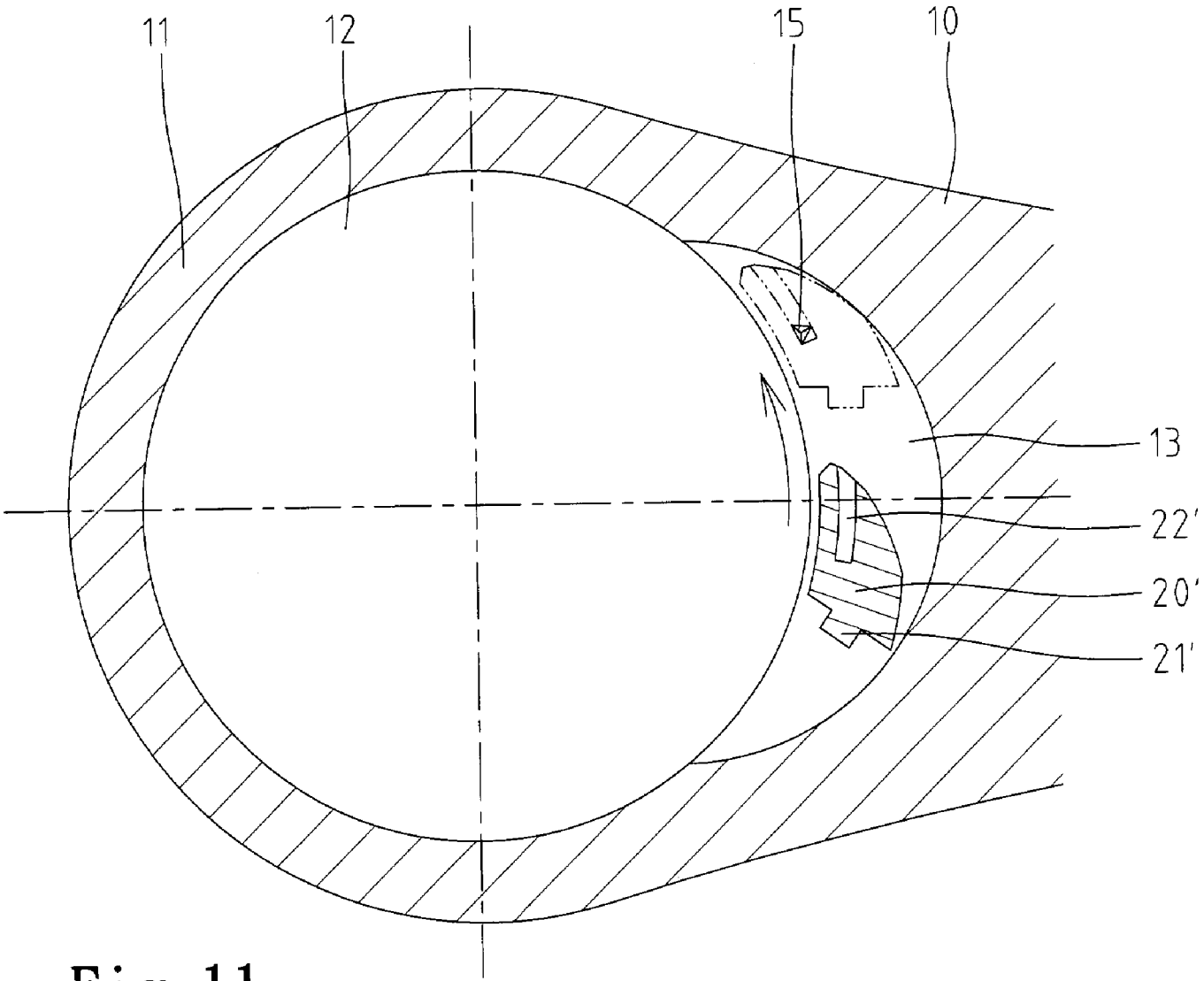
FIG. 11 is a sectional view illustrating mounting of an anchor of the ratcheting tool in FIG. 10.
Figure 12:
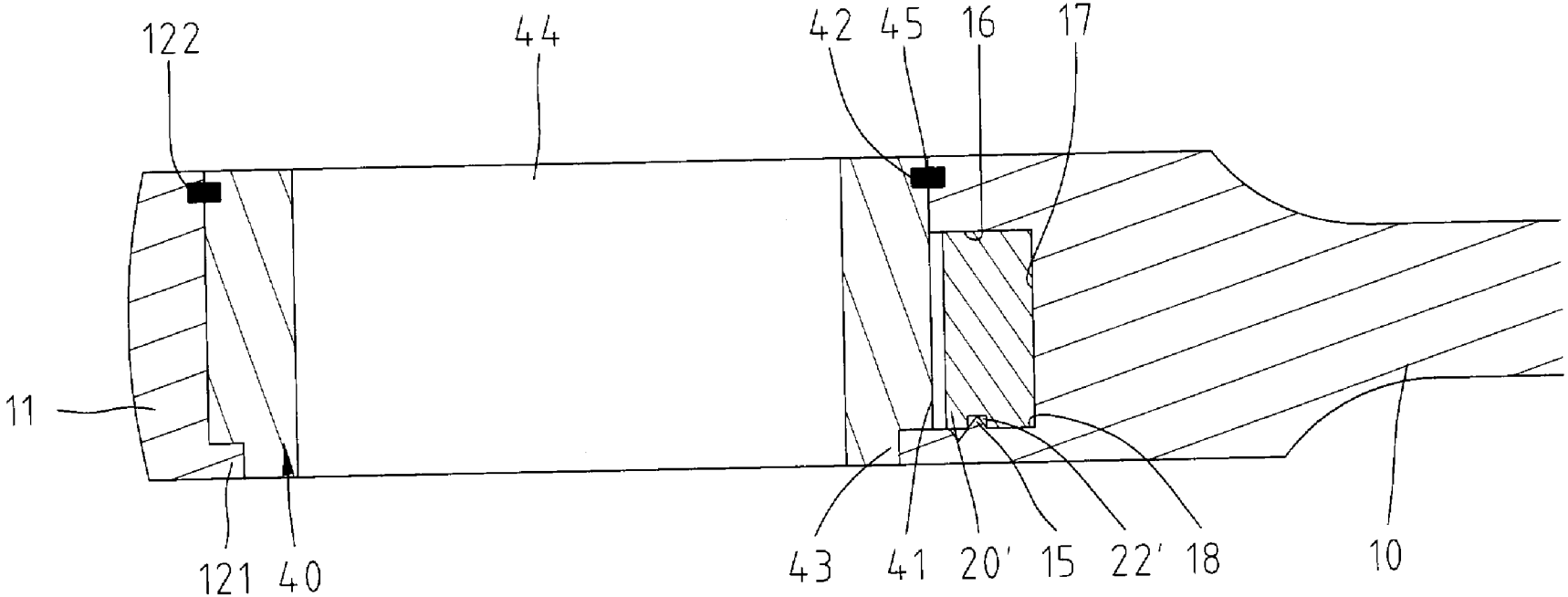
FIG. 12 is another sectional view of the ratcheting tool in FIG. 10.

FIGS. 10 through 12 illustrate a second embodiment of the ratcheting tool in accordance with the present invention, wherein the protruded portion (now designated by 15) is integrally formed on the bottom wall 18 defining the compartment 13 of the handle 10. Further, the anchor (now designated by 20') includes a peg 21' on a side thereof and a groove 22' on an underside thereof. FIG. 11 illustrates how the anchor 20' is mounted into the compartment 13 of the handle 10. The anchor 20' is slid into its position with the protruded portion 15 being engaged with the groove 22' of the anchor 20'. The anchor 20' is prevented from moving out of the compartment 13 of the handle 10 by the protruded portion 15. Namely, further upward movement (see FIG. 11) of the anchor 20' is prevented. Thus, the anchor 20' would not move out of the compartment 13 of the handle 10 and thus would not come into contact with the teeth 41 of the drive member 40, thereby preventing damage to the teeth 41 of the drive member 40.

Figure 13:
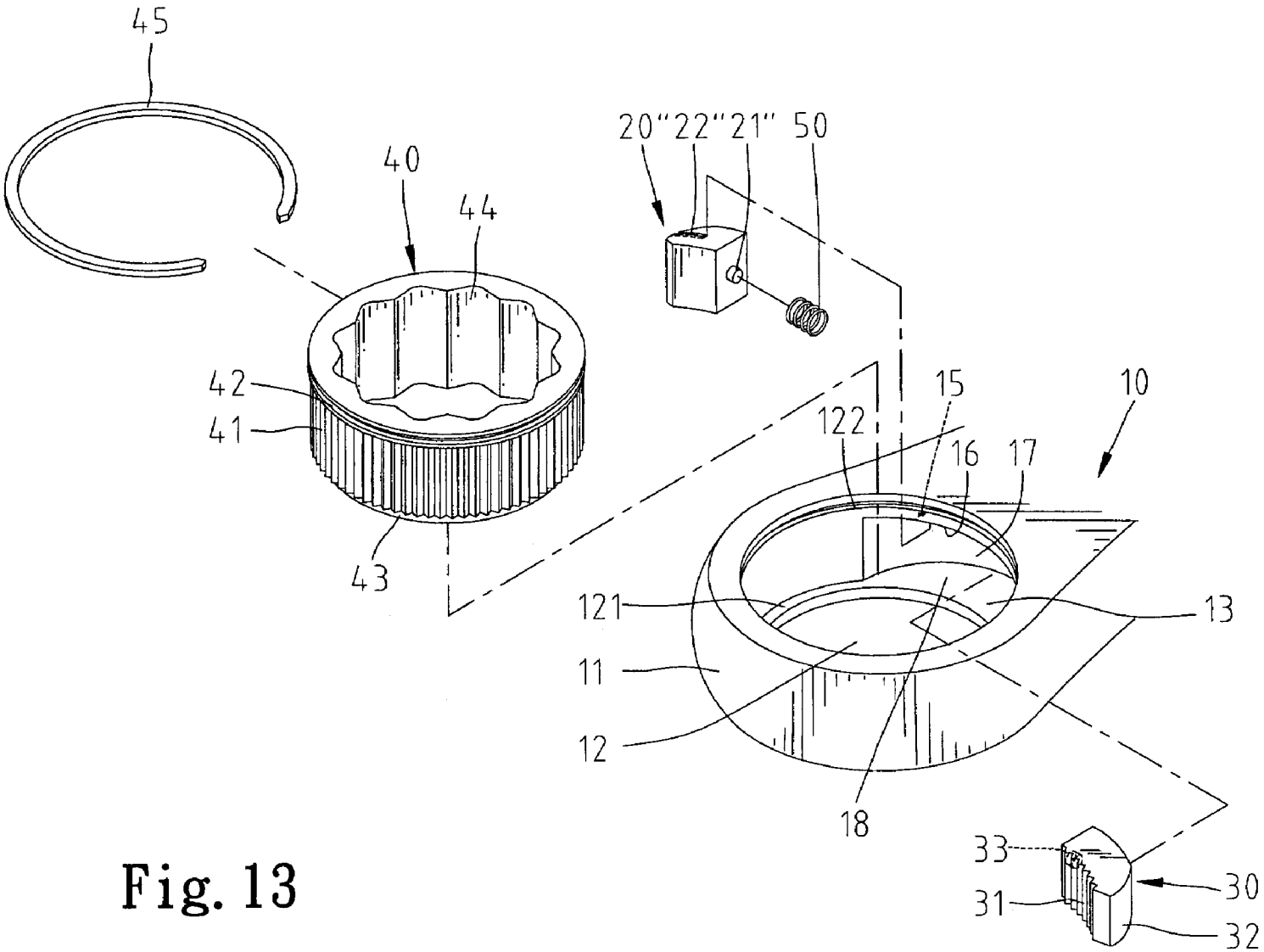
FIG. 13 is an exploded perspective view of a third embodiment of the ratcheting tool in accordance with the present invention.
Figure 14:
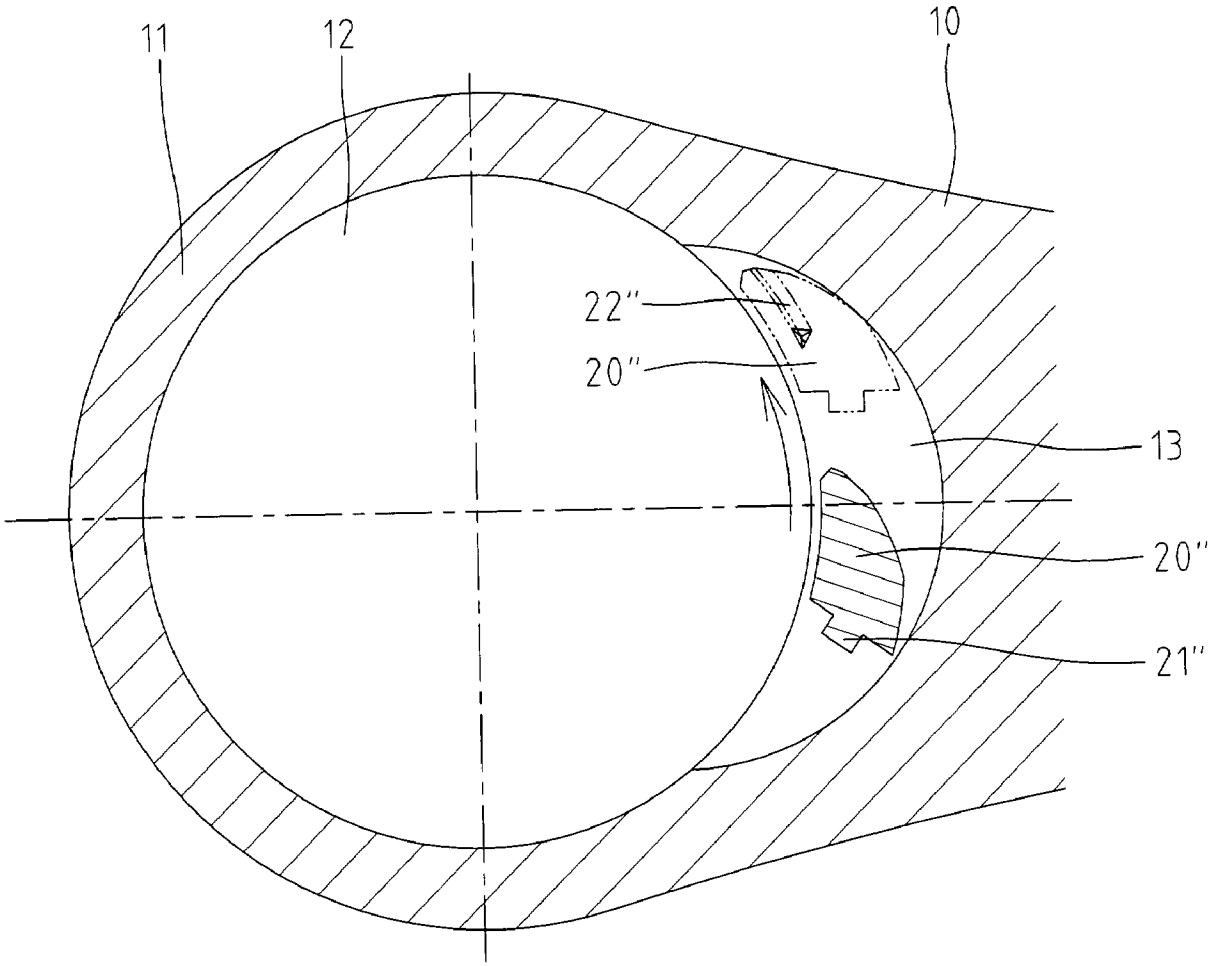
FIG. 14 is a sectional view illustrating mounting of an anchor of the ratcheting tool in FIG. 13.
Figure 15:
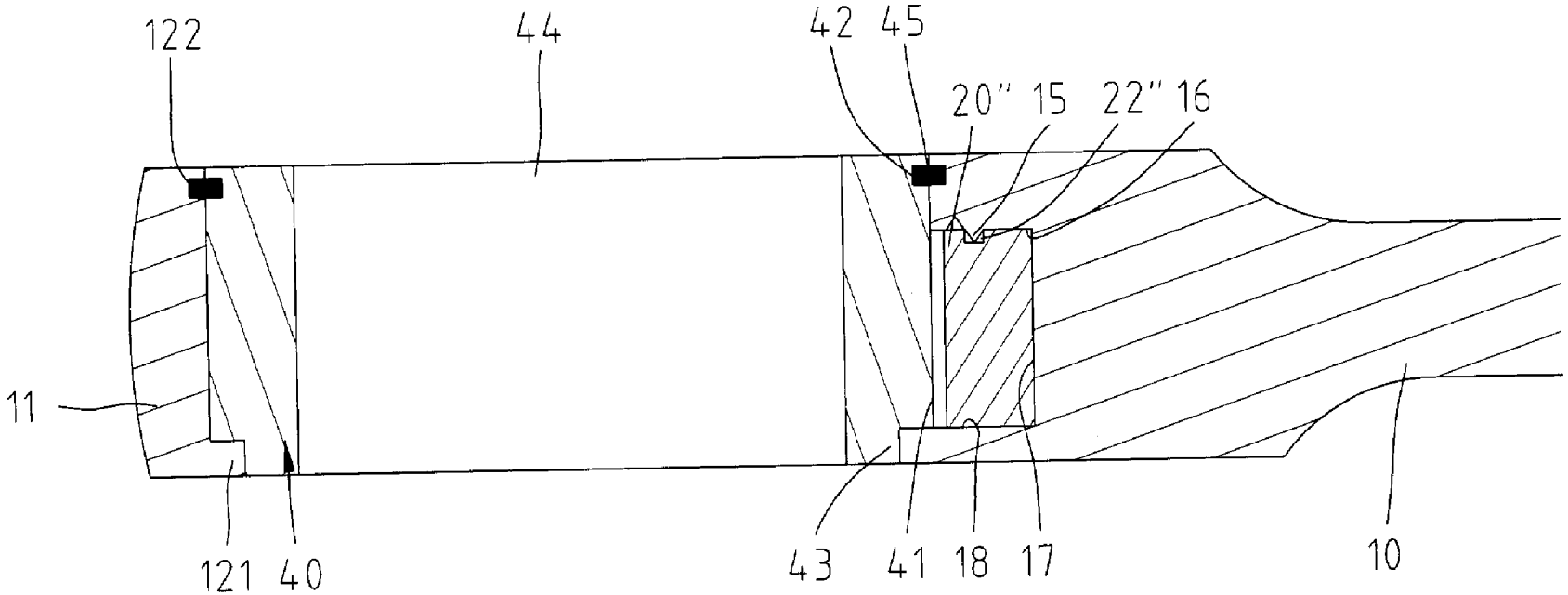
FIG. 15 is another sectional view of the ratcheting tool in FIG. 13.

FIGS. 13 through 15 illustrate a third embodiment of the ratcheting tool in accordance with the present invention, wherein the protruded portion (now designated by 15) is integrally formed on the top wall 16 defining the compartment 13 of the handle 10. Further, the anchor (now designated by 20") includes a peg 21" on a side thereof and a groove 22" on a top side thereof. FIG. 14 illustrates how the anchor 20" is mounted into the compartment 13 of the handle 10. The anchor 20" is slid into its position with the protruded portion 15 being engaged with the groove 22" of the anchor 20". The anchor 20" is prevented from moving out of the compartment 13 of the handle 10 by the protruded portion 15. Namely, further upward movement (see FIG. 14) of the anchor 20" is prevented. Thus, the anchor 20" would not move out of the compartment 13 of the handle 10 and thus would not come into contact with the teeth 41 of the drive member 40, thereby preventing damage to the teeth 41 of the drive member 40.

It is noted that the protruded portion 14 of the first embodiment is formed on an end edge of the top wall 16 defining the compartment 13 of the handle 10, the protruded portion 15 of the second embodiment is formed on an intermediate portion of the bottom wall 18 defining the compartment 13 of the handle 10, and the protruded portion 15 of the third embodiment is formed on an intermediate portion of the top wall 16 defining the compartment 13 of the handle 10. All of these arrangements prevent the anchor 20, 20', 20" from moving out of the compartment 13 of the handle 10, thereby preventing the anchor 20, 20', 20" from coming into contact with the teeth 41 of the drive member 40. Thus, damage to the teeth 41 of the drive member 40 by the anchor 20, 20', 20" is prevented.

Figure 16:
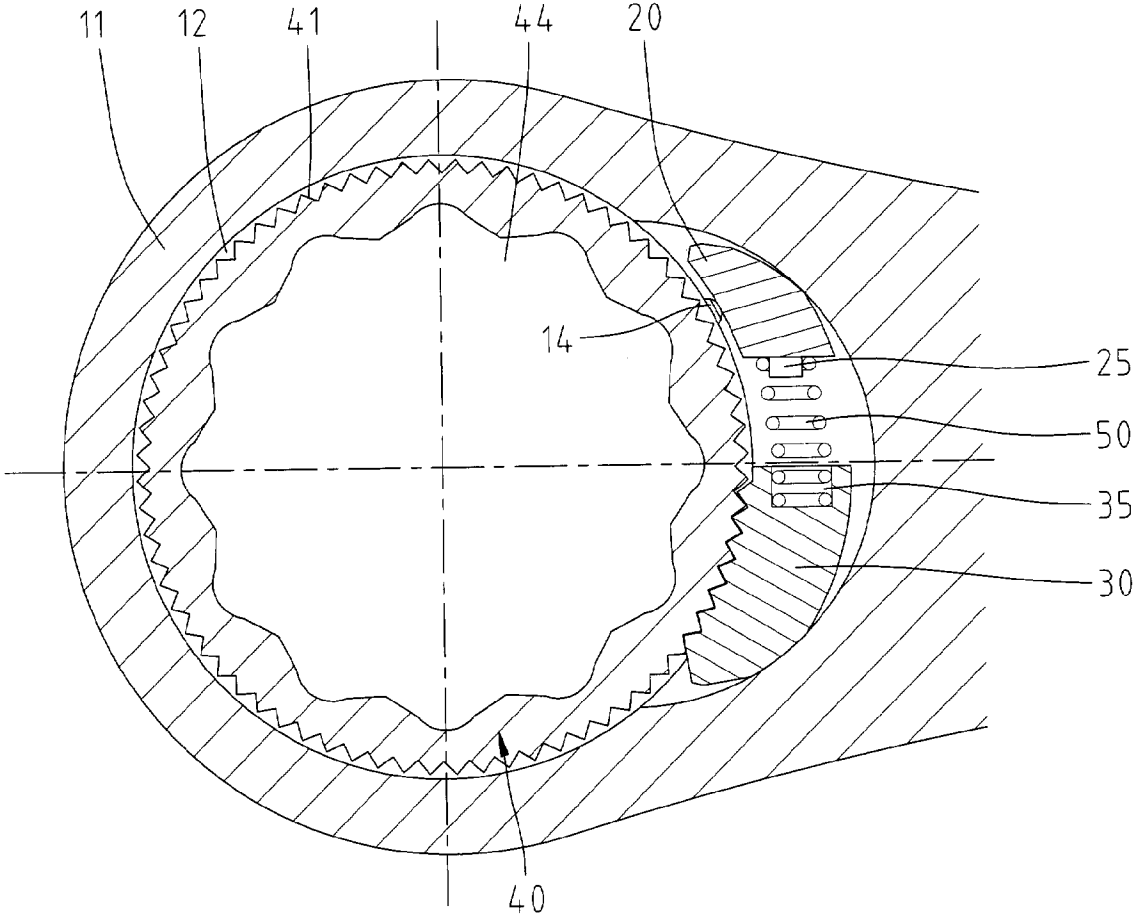
FIG. 16 is a sectional view similar to FIG. 7, illustrating a fourth embodiment of the invention.

FIG. 16 illustrates a fourth embodiment of the invention, wherein the anchor 20 includes a peg 25, the pawl 30 includes a receptacle 35. An end of the elastic element 50 is attached to the peg 25 of the anchor 20, and the other end of the elastic element 50 is mounted in the receptacle 35 of the pawl 30.

Figure 17:
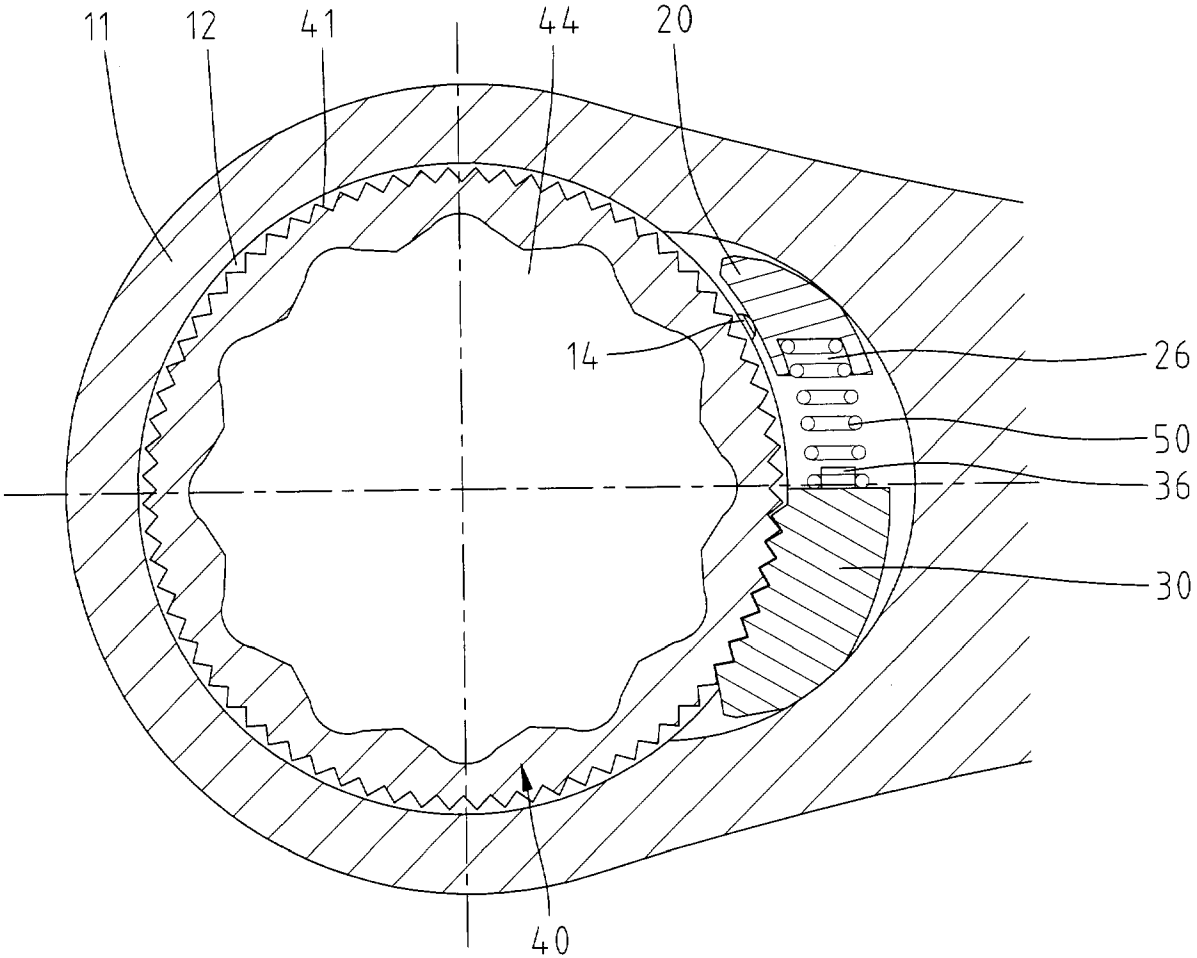
FIG. 17 is a sectional view similar to FIG. 7, illustrating a fifth embodiment of the invention.

FIG. 17 illustrates a fifth embodiment of the invention, wherein the anchor 20 includes a receptacle 26, the pawl 30 includes a peg 36. An end of the elastic element 50 is mounted in the receptacle 26 of the anchor 20, and the other end of the elastic element 50 is attached to the peg 36 of the pawl 30.

Figure 18:
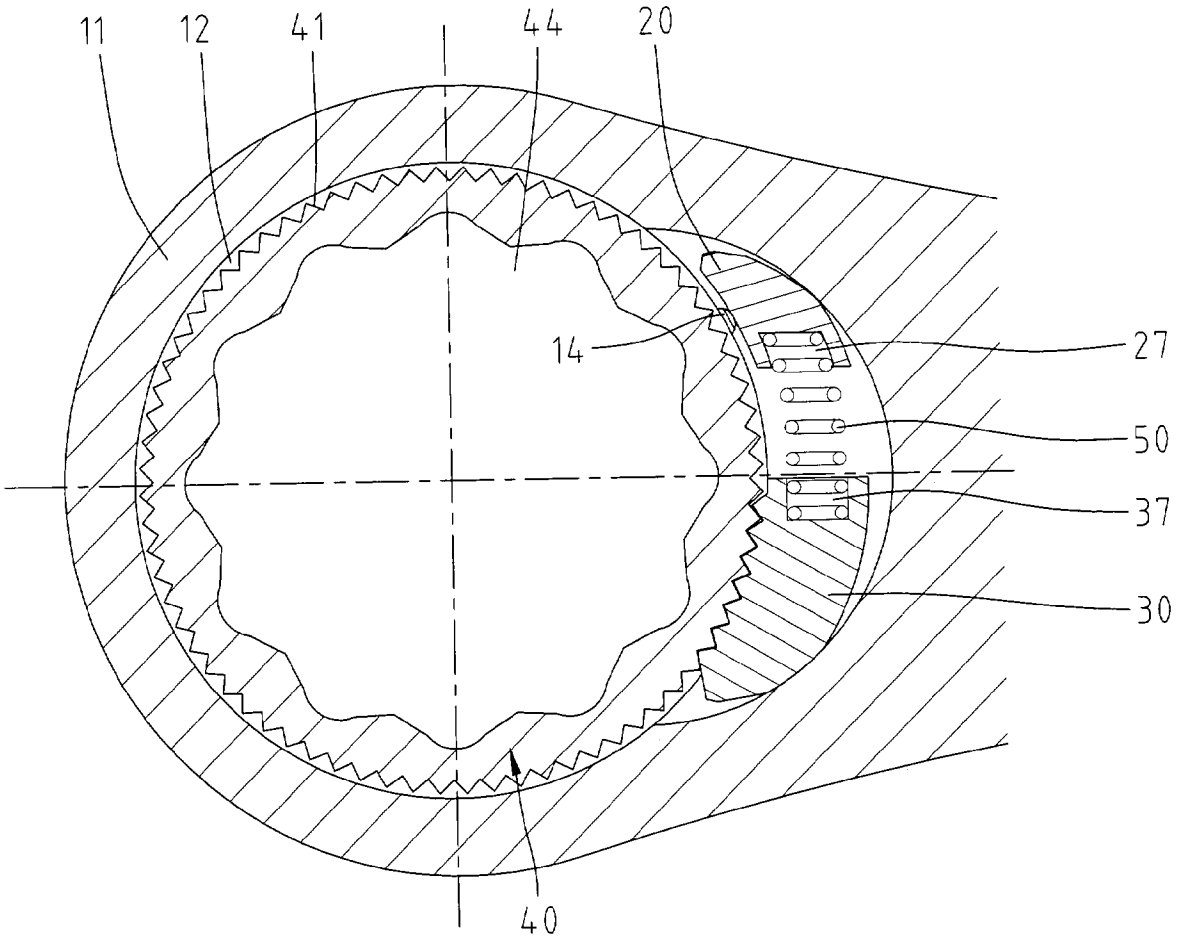
FIG. 18 is a sectional view similar to FIG. 7, illustrating a sixth embodiment of the invention.

FIG. 18 illustrates a fourth embodiment of the invention, wherein the anchor 20 includes a receptacle 27, the pawl 30 includes a receptacle 37. An end of the elastic element 50 is mounted in the receptacle 27 of the anchor 20, and the other end of the elastic element 50 is mounted in the receptacle 37 of the pawl 30.

Although the invention has been explained in relation to its preferred embodiments, it is to be understood that many other possible modifications and variations can be made without departing from the scope of the invention as hereinafter claimed.

What is claimed is:

1. A ratcheting tool comprising:

a handle;

a head extending from the handle, the head including a hole, the handle including a compartment communicated with the hole of the head, with the compartment including a top wall and a bottom wall, with the top wall and the bottom wall being planar and in a spaced parallel relation, with the compartment including a lateral wall extending between the top wall and the bottom wall and having a first end and a second end, with the first and second ends being circumferentially spaced along the hole of the head, with the lateral wall being spaced from the hole intermediate the first and second ends;

a drive member rotatably mounted about an axis in the hole of the head, the drive member including a plurality of teeth on an outer periphery thereof, with the lateral wall extending parallel to the axis of the drive member;

a pawl slidably mounted in the compartment of the handle, the pawl including a plurality of teeth on a side thereof for engaging with the teeth of the drive member;

an anchor mounted in the compartment of the handle, with the anchor located adjacent the first end and the pawl located adjacent the second end of the lateral wall of the compartment;

an elastic element attached between the pawl and the anchor for biasing the teeth of the pawl to engage with the teeth of the drive member; and a protruded portion protruding from one of the top wall and the bottom wall and spaced from the lateral wall defining the compartment of the handle, with the protruded portion being integrally formed as a unitary, unseparable component with the head spaced from the first and second ends of the lateral wall and with at least a portion of the anchor located between the protruded portion and the lateral wall for positioning the anchor in place, thereby preventing the anchor from moving out of the compartment of the handle, wherein the protruded portion is integrally formed on the top wall defining the compartment of the handle, with the compartment extending from the hole of the head spaced from an exterior of the handle and of the head, wherein the protruded portion is integrally formed on an end edge of the top wall defining the compartment and the hole of the handle.

2. The ratcheting tool as claimed in claim 1, with the anchor including a peg, with the pawl including a peg, and with two ends of the elastic element attached between the peg of the anchor and the peg of the pawl.

3. The ratcheting tool as claimed in claim 1, wherein the anchor is securely sandwiched between the protruded portion and the lateral wall defining the compartment of the handle.

4. A ratcheting tool comprising:

a handle;

a head extending from the handle, the head including a hole, the handle including a compartment communicated with the hole of the head, with the compartment including a top wall and a bottom wall, with the top wall and the bottom wall being planar and in a spaced parallel relation, with the compartment including a lateral wall extending between the top wall and the bottom wall and having a first end and a second end, with the first and second ends being circumferentially spaced along the hole of the head, with the lateral wall being spaced from the hole intermediate the first and second ends;

a drive member rotatably mounted about an axis in the hole of the head, the drive member including a plurality of teeth on an outer periphery thereof, with the lateral wall extending parallel to the axis of the drive member;

a pawl slidably mounted in the compartment of the handle, the pawl including a plurality of teeth on a side thereof for engaging with the teeth of the drive member;

an anchor mounted in the compartment of the handle, with the anchor located adjacent the first end and the pawl located adjacent the second end of the lateral wall of the compartment;

an elastic element attached between the pawl and the anchor for biasing the teeth of the pawl to engage with the teeth of the drive member; and a protruded portion protruding from one of the top wall and the bottom wall and spaced from the lateral wall defining the compartment of the handle, with the protruded portion being integrally formed as a unitary, unseparable component with the head spaced from the first and second ends of the lateral wall and with at least a portion of the anchor located between the protruded portion and the lateral wall for positioning the anchor in place, thereby preventing the anchor from moving out of the compartment of the handle, wherein the protruded portion is integrally formed on an intermediate portion of the top wall defining the compartment of the handle and located intermediate the lateral wall and an end edge of the top wall defining the compartment and the hole, with the compartment extending from the hole of the head spaced from an exterior of the handle and of the head, wherein the anchor includes a groove extending parallel to the top wall and defined in a top side thereof, with the protruded portion received in the groove, with the anchor further including an underside parallel to but spaced from the top side.

5. A ratcheting tool comprising:

a handle;

a head extending from the handle, the head including a hole, the handle including a compartment communicated with the hole of the head, with the compartment including a ton wall and a bottom wall, with the top wall and the bottom wall being planar and in a spaced parallel relation, with the compartment including a lateral wall extending between the top wall and the bottom wall and having a first end and a second end, with the first and second ends being circumferentially spaced alone the hole of the head, with the lateral wall being spaced from the hole intermediate the first and second ends;

a drive member rotatably mounted about an axis in the hole of the head, the drive member including a plurality of teeth on an outer periphery thereof, with the lateral wall extending parallel to the axis of the drive member;

a pawl slidably mounted in the compartment of the handle, the pawl including a plurality of teeth on a side thereof for engaging with the teeth of the drive member;

an anchor mounted in the compartment of the handle, with the anchor located adjacent the first end and the pawl located adjacent the second end of the lateral wall of the compartment;

an elastic element attached between the pawl and the anchor for biasing the teeth of the pawl to engage with the teeth of the drive member; and a protruded portion protruding from one of the ton wall and the bottom wall and spaced from the lateral wall defining the compartment of the handle, with the protruded portion being integrally formed as a unitary, unseparable component with the head spaced from the first and second ends of the lateral wall and with at least a portion of the anchor located between the protruded portion and the lateral wall for positioning the anchor in place, thereby preventing the anchor from moving out of the compartment of the handle, wherein the protruded portion is integrally formed on an intermediate portion of the bottom wall defining the compartment of the handle and located intermediate the lateral wall and an end edge of the bottom wall defining the compartment and the hole, with the compartment extending from the hole of the head spaced from an exterior of the handle and of the head, wherein the anchor includes a groove extending parallel to the bottom wall and defined in an underside thereof, with the protruded portion received in the groove, with the anchor further including a top side parallel to but spaced from the underside.

6. The ratcheting tool as claimed in claim 5, with the anchor including a peg, with the pawl including a receptacle, and with the elastic element having a first end attached to the peg of the anchor and a second end mounted in the receptacle of the pawl.

7. The ratcheting tool as claimed in claim 5, with the anchor including a receptacle, with the pawl including a peg, and with the elastic element having a first end mounted in the receptacle of the anchor and a second end attached to the peg of the pawl.

8. The ratcheting tool as claimed in claim 5, with the anchor including a receptacle, with the pawl including a receptacle, and with the elastic element having a first end mounted in the receptacle of the anchor and a second end mounted in the receptacle of the pawl.

9. A ratcheting tool comprising:

a handle;

a head extending from the handle, the head including a hole, the handle including a compartment communicated with the hole of the head, with the compartment including a top wall and a bottom wall, with the top wall and the bottom wall being planar and in a spaced parallel relation, with the compartment including a lateral wall extending between the top wall and the bottom wall and having a first end and a second end, with the first and second ends being circumferentially spaced along the hole of the head, with the lateral wall being spaced from the hole intermediate the first and second ends;

a drive member rotatably mounted about an axis in the hole of the head, the drive member including a plurality of teeth on an outer periphery thereof, with the lateral wall extending parallel to the axis of the drive member;

a pawl slidably mounted in the compartment of the handle, the pawl including a plurality of teeth on a side thereof for engaging with the teeth of the drive member;

an anchor mounted in the compartment of the handle, with the anchor located adjacent the first end and the pawl located adjacent the second end of the lateral wall of the compartment;

an elastic element attached between the pawl and the anchor for biasing the teeth of the pawl to engage with the teeth of the drive member; and a protruded portion protruding from one of the top wall and the bottom wall and spaced from the lateral wall defining the compartment of the handle, with the protruded portion being integrally formed as a unitary, unseparable component with the head spaced from the first and second ends of the lateral wall and with at least a portion of the anchor located between the protruded portion and the lateral wall for positioning the anchor in place, thereby preventing the anchor from moving out of the compartment of the handle, with the protruded portion located on the top wall, with the anchor further including a front side and a back side opposite to the front side, with the back side abutting with the lateral wall of the compartment, with the anchor further including a top side and an underside parallel to but spaced from the top side, with the back and front sides extending between the top side and underside of the anchor, with the protruded portion abutting with the anchor at the interconnection of the top side and front side of the anchor.

10. A ratcheting tool comprising:

a handle;

a head extending from the handle, the head including a hole, the handle including a compartment communicated with the hole of the head, with the compartment including a top wall and a bottom wall, with the top wall and the bottom wall being planar and in a spaced parallel relation, with the compartment including a lateral wall extending between the top wall and the bottom wall and having a first end and a second end, with the first and second ends being circumferentially spaced along the hole of the head, with the lateral wall being spaced from the hole intermediate the first and second ends;

a drive member rotatably mounted about an axis in the hole of the head, the drive member including a plurality of teeth on an outer periphery thereof, with the lateral wall extending parallel to the axis of the drive member;

a pawl slidably mounted in the compartment of the handle, the pawl including a plurality of teeth on a side thereof for engaging with the teeth of the drive member;

an anchor mounted in the compartment of the handle, with the anchor located adjacent the first end and the pawl located adjacent the second end of the lateral wall of the compartment;

an elastic element attached between the pawl and the anchor for biasing the teeth of the pawl to engage with the teeth of the drive member; and a protruded portion protruding from one of the top wall and the bottom wall and spaced from the lateral wall defining the compartment of the handle, with the protruded portion being integrally formed as a unitary, unseparable component with the head spaced from the first and second ends of the lateral wall and with at least a portion of the anchor located between the protruded portion and the lateral wall for positioning the anchor in place, thereby preventing the anchor from moving out of the compartment of the handle, with the protruded portion located on the bottom wall, with the anchor further including a front side and a back side opposite to the front side, with the back side abutting with the lateral wall of the compartment, with the anchor further including a top side and an underside parallel to but spaced from the top side, with the back and front sides extending between the top side and underside of the anchor, with the protruded portion abutting with the anchor at the interconnection of the underside and front side of the anchor.

11. The ratcheting tool as claimed in claim 10, with the lateral wall being arcuate having an axis spaced from and parallel to the axis of the drive member.

12. A ratcheting tool comprising:

a handle;

a head extending from the handle, the head including a hole, the handle including a compartment communicated with the hole of the head, with the compartment including a top wall and a bottom wall, with the top wall and the bottom wall being planar and in a spaced parallel relation, with the compartment including a lateral wall extending between the top wall and the bottom wall and having a first end and a second end, with the first and second ends being circumferentially spaced alone the hole of the head, with the lateral wall being spaced from the hole intermediate the first and second ends;

a drive member rotatably mounted about an axis in the hole of the head, the drive member including a plurality of teeth on an outer periphery thereof, with the lateral wall extending parallel to the axis of the drive member;

a C-clip partially received in an annular groove formed in the hole of the head, with the C-clip preventing the drive member from falling out of the hole of the head;

a pawl slidably mounted in the compartment of the handle, the pawl including a plurality of teeth on a side thereof for engaging with the teeth of the drive member;

an anchor mounted in the compartment of the handle, with the anchor located adjacent the first end and the pawl located adjacent the second end of the lateral wall of the compartment;

an elastic element attached between the pawl and the anchor for biasing the teeth of the pawl to engage with the teeth of the drive member; and a protruded portion integrally formed on one of the top wall and the bottom wall and spaced from the first and second ends of the lateral wall defining the compartment of the handle, with at least a portion of the anchor located between the protruded portion and the lateral wall for positioning the anchor in place, thereby preventing the anchor from moving out of the compartment of the handle, with the one of the top wall and the bottom wall being spaced from the C-clip, with the protruded portion being separate from and spaced from the C-clip, with the protruded portion located on the top wall, with the anchor further including a front side and a back side opposite to the front side, with the back side abutting with the lateral wall of the compartment, with the anchor further including a top side and an underside parallel to but spaced from the top side, with the back and front sides extending between the top side and underside of the anchor, with the protruded portion abutting with the anchor at the interconnection of the top side and front side of the anchor.

13. A ratcheting tool comprising:

a handle;

a head extending from the handle, the head including a hole, the handle including a compartment communicated with the hole of the head, with the compartment including a top wall and a bottom wall, with the top wall and the bottom wall being planar and in a spaced parallel relation, with the compartment including a lateral wall extending between the top wall and the bottom wall and having a first end and a second end, with the first and second ends being circumferentially spaced along the hole of the head, with the lateral wall being spaced from the hole intermediate the first and second ends;

a drive member rotatably mounted about an axis in the hole of the head, the drive member including a plurality of teeth on an outer periphery thereof, with the lateral wall extending parallel to the axis of the drive member;

a C-clip partially received in an annular groove formed in the hole of the head, with the C-clip preventing the drive member from falling out of the hole of the head;

a pawl slidably mounted in the compartment of the handle, the pawl including a plurality of teeth on a side thereof for engaging with the teeth of the drive member;

an anchor mounted in the compartment of the handle, with the anchor located adjacent the first end and the pawl located adjacent the second end of the lateral wall of the compartment;

an elastic element attached between the pawl and the anchor for biasing the teeth of the pawl to engage with the teeth of the drive member; and a protruded portion integrally formed on one of the top wall and the bottom wall and spaced from the first and second ends of the lateral wall defining the compartment of the handle, with at least a portion of the anchor located between the protruded portion and the lateral wall for positioning the anchor in place, thereby preventing the anchor from moving out of the compartment of the handle, with the one of the top wall and the bottom wall being spaced from the C-clip, with the protruded portion being separate from and spaced from the C-clip, wherein the protruded portion is integrally formed on an intermediate portion of the top wall defining the compartment of the handle and located intermediate the lateral wall and an end edge of the top wall defining the compartment and the hole, wherein the anchor includes a groove extending parallel to the top wall and defined in a top side thereof, with the protruded portion received in the groove, with the anchor further including an underside parallel to but spaced from the top side.

* * * * *